US007932876B2

(12) United States Patent
Jo et al.

(10) Patent No.: US 7,932,876 B2
(45) Date of Patent: Apr. 26, 2011

(54) ELECTRO-OPTICAL DEVICE, METHOD OF DRIVING THE SAME, AND ELECTRONIC APPARATUS

(75) Inventors: Hiroaki Jo, Suwa (JP); Toshiyuki Kasai, Okaya (JP); Hiroshi Horiuchi, Matsumoto (JP); Takeshi Nozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 956 days.

(21) Appl. No.: 11/174,729

(22) Filed: Jul. 6, 2005

(65) Prior Publication Data

US 2006/0092185 A1 May 4, 2006

(30) Foreign Application Priority Data

Oct. 19, 2004 (JP) ..... 2004-303936

(51) Int. Cl.
*G09G 3/30* (2006.01)

(52) U.S. Cl. ..... 345/76; 345/77; 345/79; 315/169.3

(58) Field of Classification Search ..... 345/76–83; 315/169.3

See application file for complete search history.

(56) References Cited

U.S. PATENT DOCUMENTS

| | | | | |
|---|---|---|---|---|
| 5,640,174 | A * | 6/1997 | Kamei et al. | 345/89 |
| 6,489,952 | B1 * | 12/2002 | Tanaka et al. | 345/205 |
| 6,738,034 | B2 | 5/2004 | Kaneko et al. | |
| 6,806,859 | B1 | 10/2004 | Kanoh et al. | |
| 6,841,948 | B2 | 1/2005 | Yoshida | |
| 6,858,989 | B2 * | 2/2005 | Howard | 315/169.1 |
| 6,864,863 | B2 | 3/2005 | Kasai | |
| 7,161,576 | B2 * | 1/2007 | Kawabe et al. | 345/99 |
| 7,262,756 | B2 | 8/2007 | Nakagawa et al. | |
| 7,525,520 | B2 * | 4/2009 | Miyazawa | 345/76 |
| 7,847,796 | B2 * | 12/2010 | Shin et al. | 345/210 |
| 2002/0190974 | A1 * | 12/2002 | Morita | 345/208 |
| 2003/0052614 | A1 * | 3/2003 | Howard | 315/169.1 |
| 2004/0061671 | A1 * | 4/2004 | Kawasaki et al. | 345/76 |
| 2004/0070557 | A1 * | 4/2004 | Asano et al. | 345/76 |
| 2004/0196219 | A1 | 10/2004 | Kaneko et al. | |
| 2007/0085794 | A1 | 4/2007 | Kawabe et al. | |
| 2007/0195039 | A1 | 8/2007 | Nakagawa et al. | |

FOREIGN PATENT DOCUMENTS

| | | |
|---|---|---|
| CN | 1464497 A | 12/2003 |
| CN | 1499476 A | 5/2004 |
| JP | A 07-92937 | 4/1995 |
| JP | A 09-26765 | 1/1997 |
| JP | A 2002-91376 | 3/2002 |
| JP | A 2002-189448 | 7/2002 |
| JP | A 2003-36056 | 2/2003 |
| JP | A 2004-118132 | 4/2004 |
| JP | A 2004-133240 | 4/2004 |
| KR | 2001-0044673 | 6/2001 |
| KR | 2004-0027363 | 4/2004 |

* cited by examiner

*Primary Examiner* — Amare Mengistu
*Assistant Examiner* — Jason M Mandeville
(74) *Attorney, Agent, or Firm* — Oliff & Berridge, PLC

(57) ABSTRACT

An electro-optical device includes a plurality of pixel circuits each including a light-emitting element and a driving transistor for driving the light-emitting element; data lines that are connected to the plurality of pixel circuits and that supply data signals representing light-emitting gray-scale levels to the pixel circuits; and a data line driving circuit that supplies the data signals to the pixel circuits through the data lines. In addition, the data line driving circuit applies to each pixel circuit in a predetermined sequence a forward frame period supplying a data signal having a forward bias voltage for making the light-emitting element emit light and a backward frame period supplying a data signal having a backward bias voltage for making the light-emitting element not emit light, and drives each of the pixel circuits.

19 Claims, 20 Drawing Sheets

: LIGHT-EMITTING PIXEL

: NON-LIGHT-EMITTING PIXEL

: LIGHT-EMITTING PIXEL

: NON-LIGHT-EMITTING PIXEL

FRAME F1

FRAME F2

FRAME F3

□ : LIGHT-EMITTING PIXEL (FORWARD BIAS)

■ : NON-LIGHT-EMITTING PIXEL (BACKWARD BIAS)

FRAME F4

FRAME F5

FRAME F6

FRAME F7

FRAME F8

FRAME F9

ELECTRO-OPTICAL DEVICE, METHOD OF DRIVING THE SAME, AND ELECTRONIC APPARATUS

BACKGROUND

The present invention relates to an electro-optical device for driving a current driving-type element, such as an organic light-emitting diode, to a method of driving the same, and to an electronic apparatus.

In recent times, display devices using the electro-optical characteristics of a self-emitting-type organic light-emitting diode element (hereinafter, referred to as an OLED element) called an organic electroluminescent element or a light-emitting polymer element have drawn attention.

A transistor for driving the OLED element (called 'a driving transistor') can be formed of amorphous silicon and can also be formed of polylsilicon. However, in the case of the driving transistor is formed of amorphous silicon, there is a problem in that a threshold voltage of the driving transistor tends to significantly change over time.

For this reason, generally, a technique has been required in which a light-emitting gray-scale level can be correctly reproduced by suppressing a change in the threshold voltage resulting from the passage of time (for example, see Japanese Unexamined Patent Application Publication No. 2004-133240, which is the related art).

In addition, a desire for correctly controlling the gray-scale level of the light-emitting element is not limited to devices using transistors formed of the amorphous silicon, but it is a common problem in electro-optical devices including a plurality of pixel circuits each having a light-emitting element.

SUMMARY

An advantage of the invention is that it provides a technique for correctly reproducing a light-emitting gray-scale level of a light-emitting element.

According to an aspect of the invention, there is provided an electro-optical device including: a plurality of pixel circuits each including a light-emitting element and a driving transistor driving the light-emitting element; data lines that are connected to the plurality of pixel circuits and supply data signals representing light-emitting gray-scale levels to the pixel circuits; and a data line driving circuit that supplies the data signals to the pixel circuits through the data lines. In addition, the data line driving circuit applies to each pixel circuit in a predetermined sequence a forward frame period supplying a data signal having a forward bias voltage for making the light-emitting element emit light, and a backward frame period supplying a data signal having a backward bias voltage for making the light-emitting element not emit light and drives each of the pixel circuits.

According to this aspect, since the forward bias voltage and the backward bias voltage can be applied to the pixel circuits, a change in the threshold voltage of the transistor due to the passage of time generated when only the forward bias voltage is applied can be suppressed, which allows a correct light-emitting gray-scale level to be maintained.

It is preferable that the data line driving circuit carry out switching between the forward frame period and the backward frame period in the predetermined sequence, and apply any one of the forward frame period and the backward frame period to all of the plurality of the pixel circuits.

In this case, all pixels are viewed as non-emitting light (black display) in the backward frame period, so that images (in particular, moving pictures) are clearly viewed.

It is preferable that the plurality of pixel circuits be divided into pixel blocks each having a predetermined size, and the data line driving circuit carry out switching between the forward frame period and the backward frame period in the predetermined sequence per each pixel block.

In this case, an effective image can be always and advantageously displayed by some of the pixel circuits.

Further, it is preferable that the plurality of pixel circuits be arranged in a matrix, and each pixel block be composed of a plurality of pixel circuits corresponding to one row.

Furthermore, it is preferable that the plurality of pixel circuits be arranged in a matrix, and each pixel block be composed of a plurality of pixel circuits corresponding to one column.

Preferably, the plurality of pixel circuits may be divided into first and second pixel circuit groups, and the data line driving circuit may apply a first combined frame applying period for which the forward frame period is applied to the first pixel circuit group while the backward frame period is applied to the second pixel circuit group, and a second combined frame applying period for which the backward frame period is applied to the first pixel circuit group while the forward frame period is applied to the second pixel circuit group in the predetermined sequence.

In this case, an effective image can be always and advantageously displayed by some of the pixel circuits.

It is preferable that the first pixel circuit group be discriminated from the second pixel circuit group on a pixel block unit having a predetermined size.

Further, it is preferable that the plurality of pixel circuits be arranged in a matrix, and the pixel block be composed of a plurality of pixel circuits corresponding to one row.

Furthermore, it is preferable that the plurality of pixel circuits be arranged in a matrix, and the pixel block be composed of a plurality of pixel circuits corresponding to one column.

Preferably, the data line driving circuit may apply the backward frame period once after applying the forward frame period to each of the pixel circuits M times (M is an integer equal to or greater than 1), and determine a backward bias voltage applied to the data line in the backward frame period in response to a sum of N forward bias voltages applied to the data line in the forward frame period for the M times right before the backward frame period.

In this case, since the backward bias voltage can be set to a proper value in accordance with a sum of M forward bias voltages, a change in the threshold voltage of the driving transistor due to the passage of time can be more appropriately suppressed.

Preferably, the data line driving circuit may set the backward bias voltage such that a first value obtained by a multiplication of a backward bias voltage applied to the data line and its applying period in the backward frame period, and a second value obtained by a multiplication of a forward bias voltage applied to the data line and its applying period in the previous M forward frame periods have the same absolute value but have polarities opposite to each other.

In this case, the backward bias voltage can be set to a more appropriate value.

Preferably, the data line driving circuit may carry out alternative switching between the forward frame period and the backward frame for each pixel circuit and set the backward bias voltage such that a backward bias voltage applied to the data line in the backward frame period and a forward bias voltage applied to the data line in the previous forward bias period have the same absolute value but have polarities opposite to each other.

In this case, the backward bias voltage and the forward bias voltage can alternately applied, so that the backward bias voltage can be set to a more appropriate value.

It is preferable that the data line driving circuit set the backward bias voltage to a predetermined constant value.

In this case, a simple structure allows the change in the threshold voltage of the driving transistor due to the passage of time to be suppressed.

Preferably, the data line driving circuit includes a forward bias generating circuit generating a plurality of forward bias voltages representing a plurality of light-emitting gray-scale levels; a backward bias generating circuit generating a plurality of backward bias voltages each having the same potential difference as and a polarity opposite to each of the plurality of the forward bias voltages with respect to a predetermined reference voltage; and a selection circuit selecting any one among the plurality of forward bias voltages and the plurality of backward bias voltages to apply the selected one to the data line.

In this case, the backward bias voltage having a proper value can be generated.

Preferably, the data line driving circuit includes a power supply circuit supplying a high forward bias potential and a low forward bias potential used to generate a plurality of forward bias voltages representing a plurality of light-emitting gray-scale levels, and a high backward bias potential and a low backward bias potential used to generate a plurality of backward bias voltages each having the same potential difference as and a polarity opposite to each of the plurality of forward bias voltages with respect to a predetermined reference voltage; a voltage dividing circuit having a plurality of resistors, and a plurality of voltage supplying lines for extracting voltages divided by the plurality of the resistors; a first switch selecting any one between the high forward bias potential and the low backward bias potential and connecting the selected one to a high voltage terminal of the voltage dividing circuit; and a second switch selecting any one of the low forward bias potential and the high backward bias potential and connecting the selected one to a low voltage terminal of the voltage dividing circuit.

In this case, only one voltage dividing circuit may be employed, so that the circuit can be simplified.

Further, it is preferable that the light-emitting element be an organic EL element.

Furthermore, it is preferable the driving transistor be a transistor formed of amorphous silicon.

When the driving transistor is formed of amorphous silicon, the threshold voltage of the driving transistor tends to change due to the passage of time, so that the effect of the invention becomes significant.

In addition, the invention can be achieved in various aspects, for example, an electro-optical device, a driving circuit for the same, an electronic apparatus having the electro-optical device, a method of driving these devices, computer program for implementing the method or a function of the device, a recording medium in which the computer program is recorded, a data signal implemented within a carrier wave and containing the computer program and so forth can be employed.

BRIEF DESCRIPTION OF THE DRAWINGS

The invention will be described with reference to the accompanying drawings, wherein like numbers reference like elements, and wherein.

DETAILED DESCRIPTION OF EMBODIMENTS

Next, preferred embodiments of the invention will be described according to the following order.

A. First embodiment

B. Modification of the first embodiment

C. Second embodiment

D. Third embodiment

E. Fourth embodiment

F. Fifth embodiment
G. Sixth embodiment
H. Other modifications

A. First Embodiment

Figure 1:
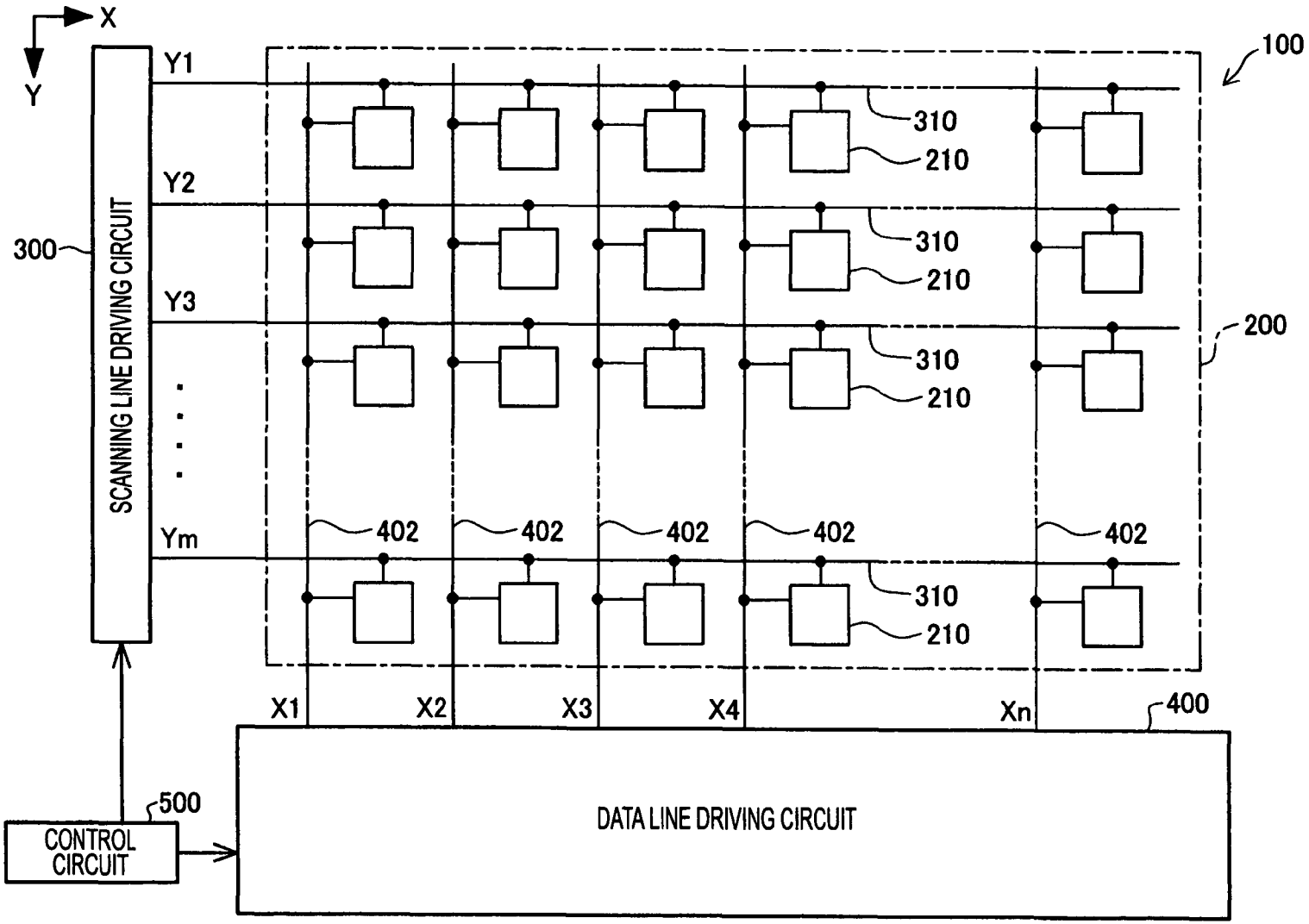
FIG. 1 is a block diagram schematically illustrating a structure of an electro-optical device according to a first embodiment of the invention.

FIG. 1 is a block view schematically illustrating the structure of an electro-optical device according to a first embodiment of the invention. This electro-optical device 100 includes a pixel region 200, a scanning line driving circuit 300, a data line driving circuit 400, and a control circuit 500. The electro-optical device 100 is an image display device for displaying images on the pixel region 200. In addition, in the description below, an X direction shown in FIG. 1 is called a row direction and a Y direction shown in FIG. 1 is called a column direction.

In the pixel region 200, m scanning lines 310 extending in the X direction (row direction) are arranged parallel to each other. Further, in the pixel region 200, n data lines 402 extending in the Y direction (column direction) orthogonal to the X direction are arranged parallel to each other. In addition, one pixel circuit 210 is provided at an intersection of any one of the scanning lines 310 and any one of the data lines 402. That is, in the pixel region 200, the pixel circuits 210 are provided in a matrix of m rows and n columns.

The scanning line driving circuit 300 generates scanning signals Y1 to Ym corresponding to the respective scanning lines 310 of the first to m-th rows, and outputs these scanning signals Y1 to Ym to the corresponding scanning lines 310. The data line driving circuit 400 generates gray-scale signals X1 to Xn for controlling gray-scale levels displayed by the pixel circuits 210, and supplies them to the respective pixel circuits 210 through the data lines 402. In addition, the gray-scale signals X1 to Xn are also called 'data signals'.

Figure 2:
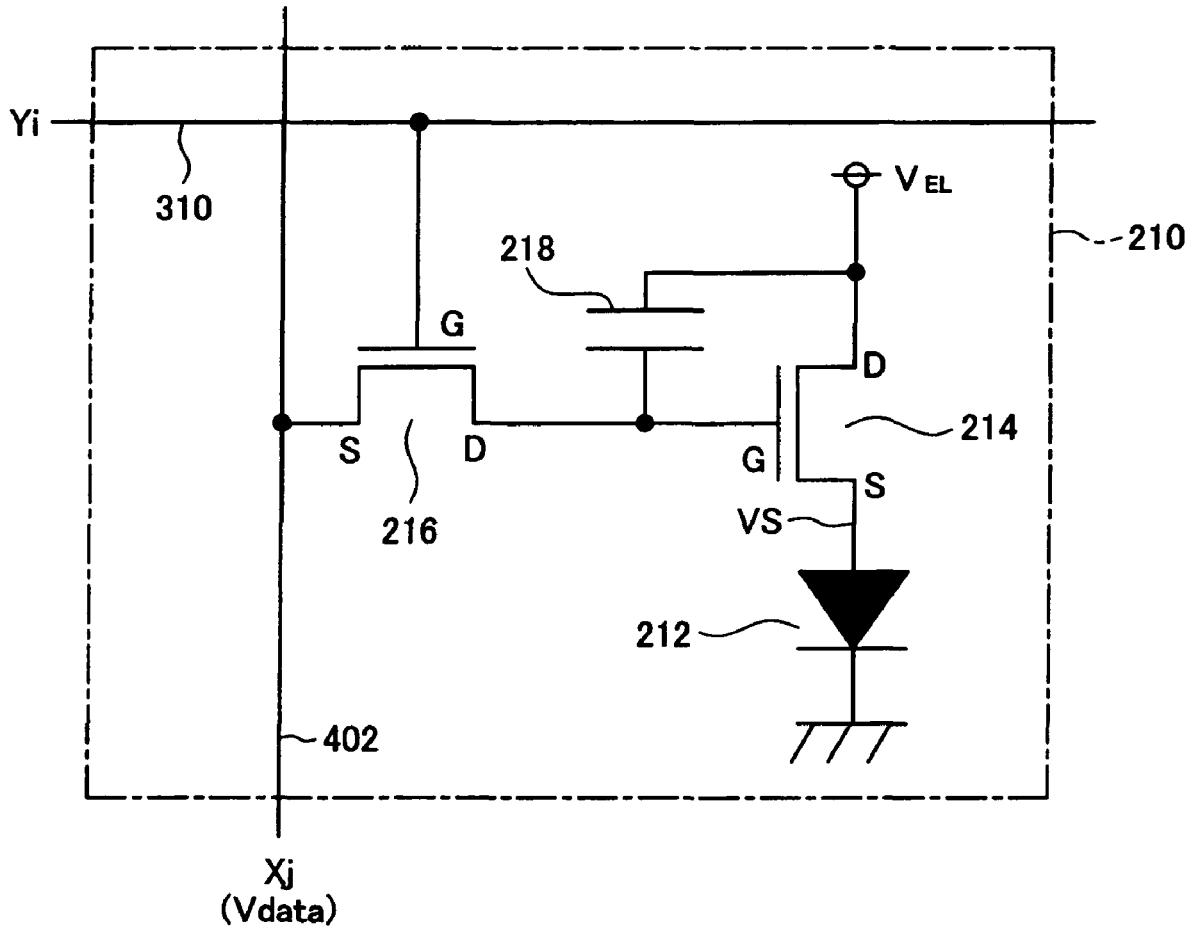
FIG. 2 is a diagram illustrating an example of a pixel circuit.

FIG. 2 is a diagram illustrating an example of a pixel circuit located at the i-th row and the j-th column. The pixel circuit 210 has an OLED element 212 functioning as a self-emitting element, an n-channel TFT 214 functioning as a driving element, an n-channel TFT 216 functioning as a switching element, and a capacitor element 218. This pixel circuit 210 is a voltage programming-type pixel circuit in which a light-emitting gray-scale level is set by a voltage level of a data signal Xj.

The OLED element 212 has a light-emitting layer interposed between an anode and a cathode, and emits light with a luminance according to a forward current. For the light-emitting layer, organic EL materials according to a light-emitting color (for example, any one of three primary colors, including red (R), green (G), and blue (B)) of the OLED element 212 of each pixel circuit 210 are used. The cathode of the OLED element 212 is commonly used in all the pixel circuits 210.

The TFT 214 has a drain electrode connected to a high reference voltage VEL, and a source electrode connected to an anode of the OLED element 212, and a gate electrode connected to a drain electrode of the TFT 216. One end of the capacitor element 218 is connected to the drain electrode of the TFT 214, and the other end is connected to the gate electrode of the TFT 214 and the drain electrode of the TFT 216. The gate electrode of the TFT 216 is connected to the scanning line 310, and the source electrode is connected to the data line 402.

The pixel circuit 210 is a simple two-transistor-type pixel circuit in which the number of transistors is two, and the two TFTs 214 and 216 are formed of amorphous silicon. When the amorphous silicon is used, a threshold voltage of the TFT 214 functioning as a driving transistor (hereinafter, referred to as 'a driving transistor 214') tends to change over time. When the threshold voltage of the driving transistor 214 changes, a value of a current flowing through the driving transistor 214 changes. As a result, the amount of emitted light from the OLED element 212 also changes. Therefore, in order to maintain a correct light-emitting gray-scale level, it is preferable to correct for the shifted threshold voltage of the driving transistor 214 when the light is emitted (that is, to prevent the threshold voltage from changing due to the passage of time). However, in order to prevent the threshold voltage of the driving transistor 214 from changing due to the passage of time, a circuit for applying a backward bias voltage to the driving transistor 214 may be provided in the pixel circuit. However, such a pixel circuit is not preferable because the size of the circuit increases and the number of pixels per unit area thus decreases. According to the present embodiment, the circuit for applying the backward bias voltage to the driving transistor 214 is not provided in the pixel circuit 210. Instead, the data line driving circuit 400 (see FIG. 1) applies the backward bias voltage to the data line 402, so that the change in the threshold voltage in response to the passage of time can be prevented from occurring.

In addition, the 'bias voltage' of the present specification means a voltage applied between the source electrode and the gate electrode of the driving transistor 214.

Figure 3:
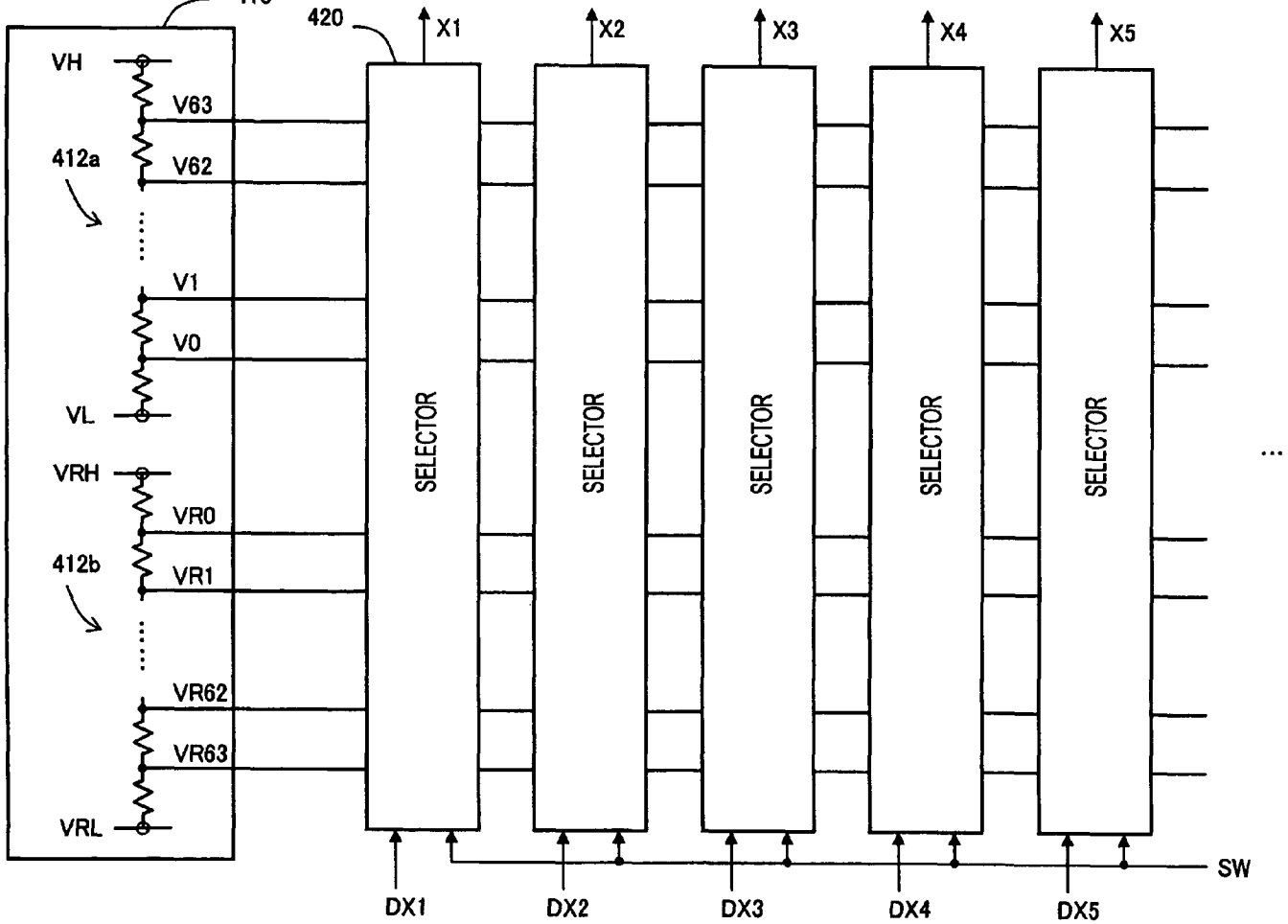
FIG. 3 is a block diagram illustrating an internal structure of a data line driving circuit in the first embodiment.

FIG. 3 is a block view illustrating an internal structure of the data line driving circuit 400 according to the first embodiment of the invention. This data line driving circuit 400 has a data voltage generating circuit 410, and selectors 420 provided for every data line. The data voltage generating circuit 410 has a first voltage dividing circuit 412*a* for generating a plurality of forward bias voltages V0 to V63, and a second voltage dividing circuit 412*b* for generating a plurality of backward bias voltages VR0 to VR63.

Figure 4:
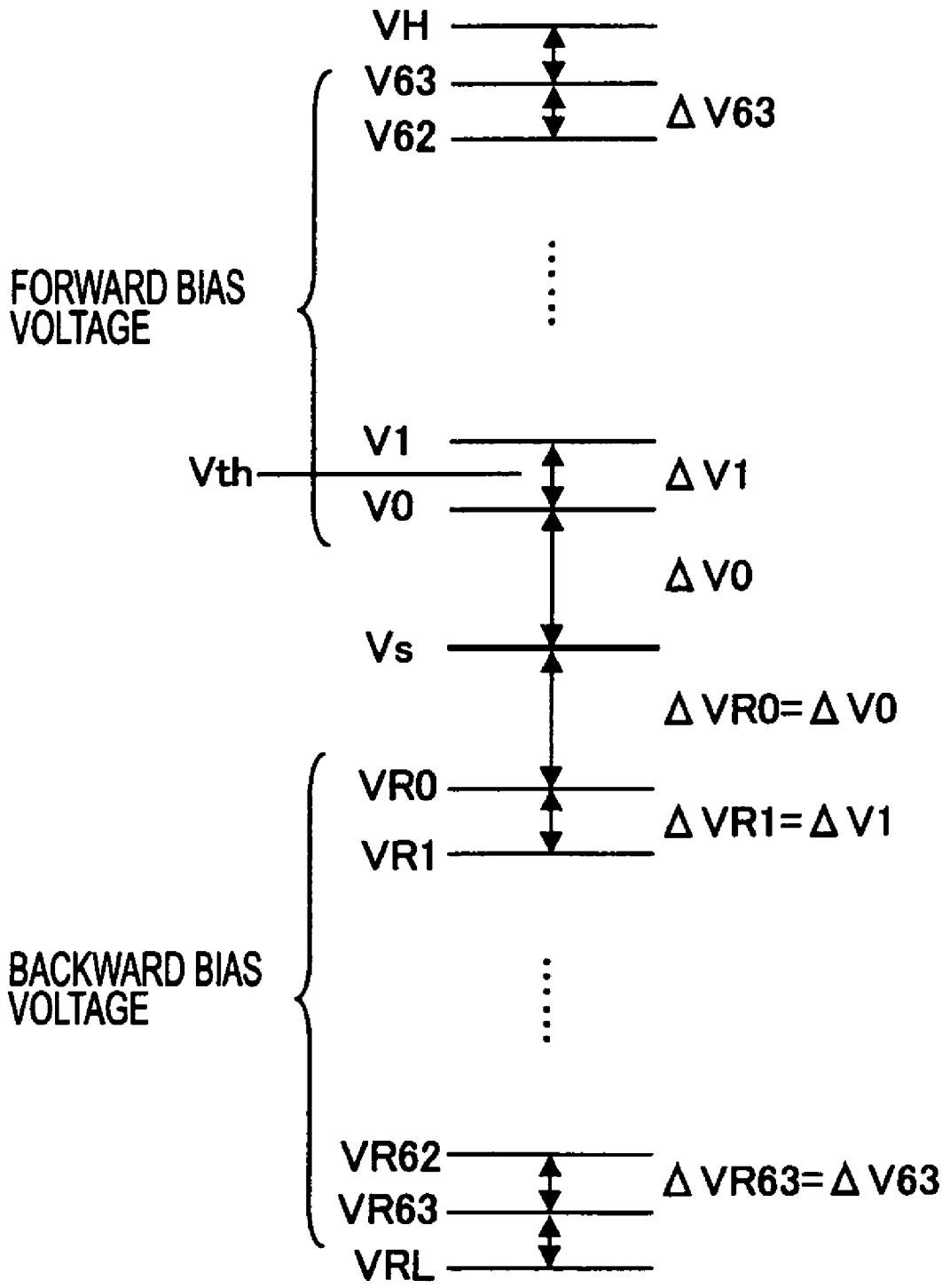
FIG. 4 is a diagram illustrating the relationship between forward bias voltages V0 to V63 and backward bias voltages VR0 to VR63.

FIG. 4 is a diagram illustrating the relationship between the forward bias voltages V0 to V63 and the backward bias voltages VR0 to VR63. The forward bias voltages V0 to V63 are voltages representing 64 gray-scale levels which can be reproduced in one pixel circuit. That is, when a capacitance value of the capacitor element 218 within the pixel circuit 210 is set using any one among the forward bias voltages V0 to V63, the OLED element 212 emits light with a gray-scale level according to the set capacitance value. However, the lowest forward bias voltage V0 is a voltage for non-light emitting display (black display). That is, the forward bias voltage V0 for black display is set to a voltage level lower than the threshold voltage of the driving transistor 214.

The backward bias voltages VR0 to VR63 are used to prevent the change in the threshold voltage of the driving transistor 214 due to the passage of time. Levels of these backward bias voltages VR0 to VR63 are lower than that of the threshold voltage Vth, and are levels which do not allow the OLED element 212 to emit light.

The forward bias voltage Vn (n=0 to 63) has a potential higher than the source voltage Vs of the driving transistor 214 when the OLED element 212 emits light, and the backward bias voltage VRn (n=0 to 63) has a potential lower than the source voltage Vs. In the present embodiment, the backward bias voltage VRn is set such that a difference between the source voltage Vs and the forward bias voltage Vn is equal to a difference between the source voltage Vs and the backward bias voltage VRn.

That is, the relationship between the forward bias voltage Vn and the backward bias voltage VRn is as follows.

$$VRn=Vs-(Vn-Vs) \quad (1)$$

That is, as shown in FIG. 4, the forward bias voltage differences ΔV0 to ΔV63 are made to be equal to the backward bias voltage differences ΔVR0 to VR63.

In addition, the value of the source voltage Vs of the driving transistor 214 when the OLED element 212 emits light is experimentally determined in advance. Accordingly, the backward bias voltage VRn is set to a voltage value having an electric potential symmetrical to the forward bias voltage Vn when considering this source voltage Vs as a predetermined reference voltage.

The first voltage dividing circuit 412*a* shown in FIG. 3 is a circuit which carries out voltage division between the high reference voltage VH and the low reference voltage VL for forward bias by means of a plurality of resistors. The second voltage dividing circuit 412*b* is a circuit which carries out voltage division between the high reference voltage VRH and the low reference voltage VRL for backward bias by means of a plurality of resistors.

The forward bias voltages V0 to V63 and the backward bias voltages VR0 to VR63 are supplied to each of the selectors 420 shown in FIG. 3. In addition, an image data signal DXj (j is an integer indicating the column) and a switching signal SW are supplied to each of the selectors 420 from the control circuit 500. The switching signal SW is a signal indicating whether a forward bias voltage or a backward bias voltage must be applied, and is commonly applied to all the columns. The selector 420 selects any one among the forward bias voltages V0 to V63 and the backward bias voltages VR0 to VR63 in response to these signals DXj and SW, and outputs the selected voltage Xj (j is an integer indicating the column) to the data line 402 as a data signal (see FIG. 1).

Figure 5:
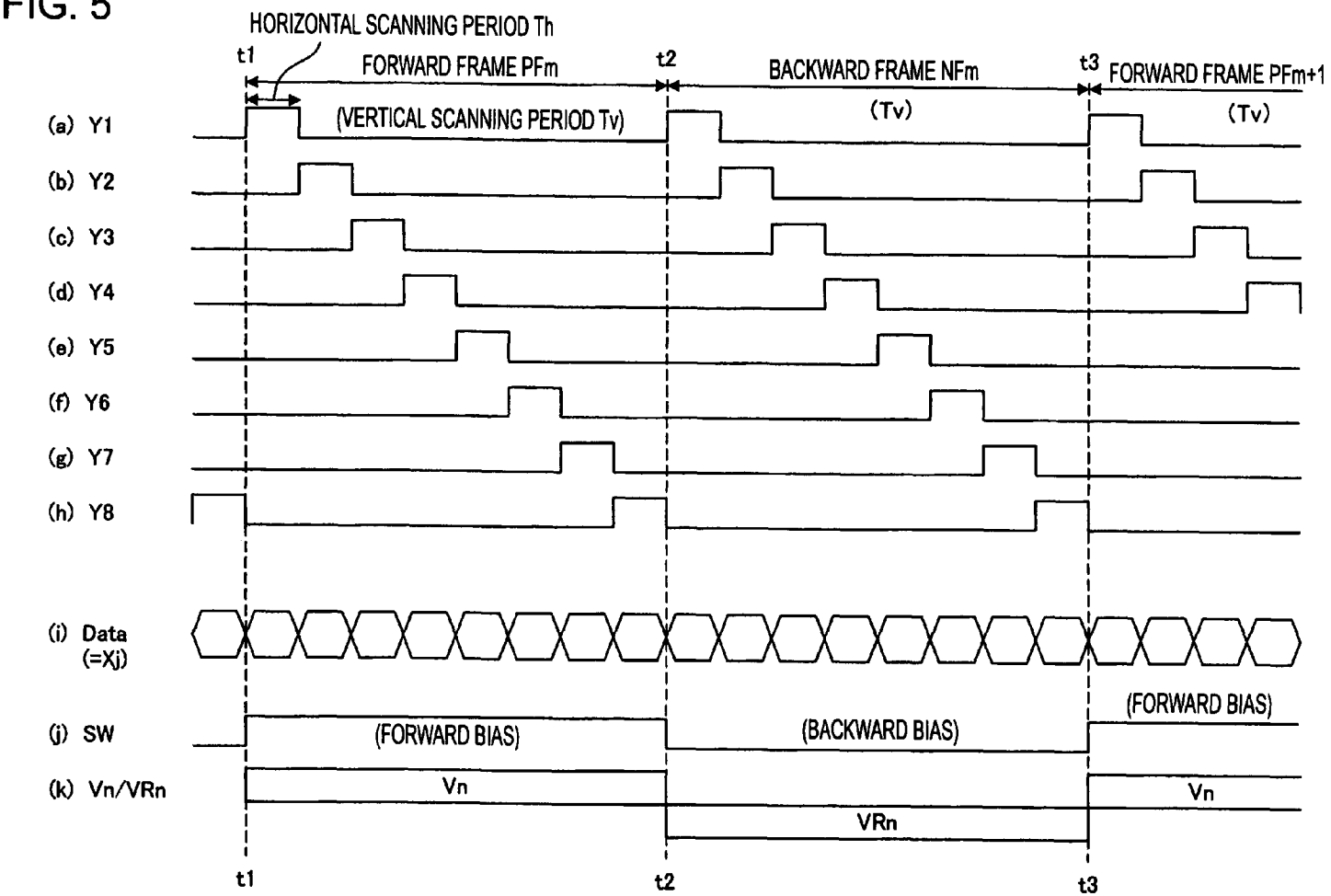
FIG. 5 is a timing chart illustrating the operation of the electro-optical device in the first embodiment.

FIG. 5 shows timing charts illustrating operations of the electro-optical device 100 according to the first embodiment of the invention. In this case, it is assumed that the pixel region 200 (see FIG. 1) is composed of eight rows, and eight scanning signals Y1 to Y8 are illustrated in (a) to (h) of FIG. 5. The scanning signal Y1 outputted to the signal line 310 of the first row is a pulse signal which becomes a high (H) level during one horizontal scanning period Th from an initial timing of one vertical scanning period to the horizontal scanning period Th within one vertical scanning period Tv, and which becomes a low (L) level for the other period. In addition, the scanning signal Y2 outputted to the scanning line 310 of the second row is a pulse signal which becomes an H level during one horizontal scanning period Th from a timing when a voltage level of the scanning signal Y1 is changed from the H level to the L level. As such, these scanning signals Y1 to Y8 become an H level only during the one horizontal scanning period Th within one vertical scanning period Tv. In this case, a pattern wherein the period having the H level is sequentially shifted is repeated for each vertical scanning period Tv. One vertical scanning period Tv is called 'one frame period' or 'one frame'. When the scanning signal Y1 supplied to the scanning line 310 of the i-th row becomes an H level, a plurality of pixel circuits 210 connected to the scanning line 310 of the i-th row are selected, and a capacitance in response to a voltage of the data signal Xj ((i) of FIG. 5) is set in the capacitor element 218 in the pixel circuit 210. This operation is called 'voltage programming' or 'programming'. The scanning line driving circuit 300 initially carries out programming on the plurality of pixel circuits 210 connected to the scanning line 310 of the first row, and then carries out programming on the pixel circuits 210 connected to the scanning line 310 of the second row until the eighth row in a sequential manner one by one, and then returns to the first row to repeat the programming on the pixel circuits 210. Each of the pixel circuits 210, after the programming is carried out, continues to emit light with a constant gray-scale level until the next programming is carried out.

The switching signal SW ((j) of FIG. 5) has a level (in this case, an H level) representing a forward bias during one vertical scanning period Tv (forward frame period PFm) from the time t1 of FIG. 5, and the forward bias voltage Vn (n=0 to 63) is selected as a data signal, as shown in (k) of FIG. 5, for this period ((k) of FIG. 5). The switching signal SW has a level (in this case, an L level) representing a backward bias during one vertical scanning period Tv (backward frame period NFm) from the next time t2, and the backward bias voltage VRn (n=0 to 63) is selected as a data signal. In addition, the switching signal SW has a level representing a forward bias during one vertical scanning period Tv (forward frame PFm+1) from the time t3. As such, the forward frame period PF for which the forward bias voltage Vn is applied to all the pixel circuits 210, and the backward frame period NF for which the backward bias voltage VRn is applied to all the pixel circuits 210 are alternately applied, in the first embodiment. During the backward frame period NF, all the pixel circuits 210 are set to a non-light-emitting state.

Figure 6A:
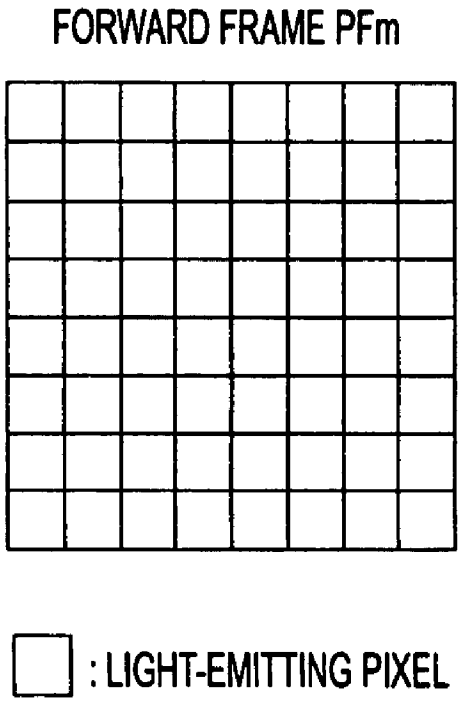
FIG. 6 is a diagram illustrating a setting state of a light-emitting gray-scale level in three frame periods PFm, NFm, and PFm+1 illustrated in FIG. 5.
Figure 6B:
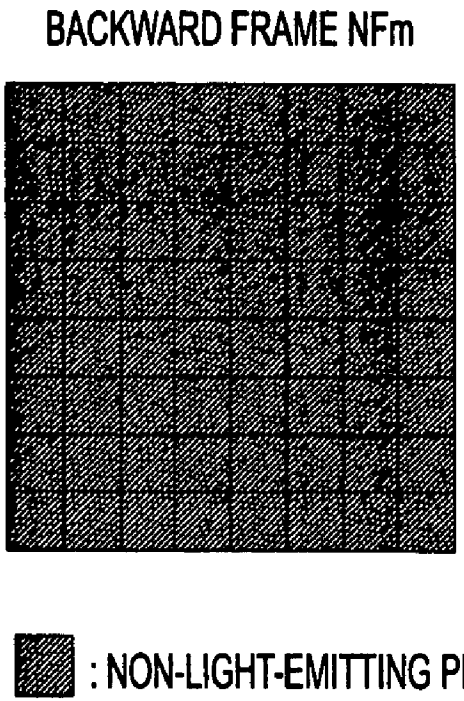
Figure 6C:
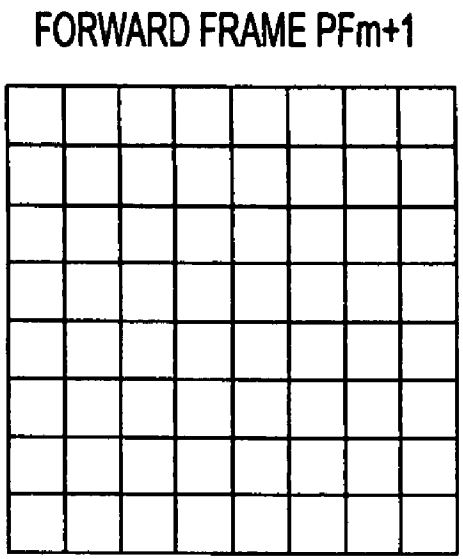

FIG. 6 is a diagram illustrating states of setting the light-emitting gray-scale levels when programming is finished in the three frame periods PFm, NFm, and PFm+1 of FIG. 5. The forward frame period PFm is a period for which a light-emitting gray-scale level is set for an image corresponding to the m-th effective frame, and can be set to make all pixels emit light when programming is finished for the forward frame period PFm, as shown in FIG. 6A. However, it is determined by image data whether each pixel is allowed to emit light. Specifically, a pixel to which the forward bias voltage Vo representing a lowest gray-scale level is applied does not emit light. As shown in FIG. 6B, all pixels are set to a non-light emitting state when programming is finished for the backward frame period NFm. In addition, as shown in FIG. 6C, the forward frame period PFm+1 is a period for setting a light-emitting gray-scale level of an image corresponding to the (m+1)-th effective frame. As such, the period for which the light-emitting gray-scale level for displaying an effective image is set is half the total period, and the period for setting a light emitting state is also half the total period, in the first embodiment.

When a backward bias voltage VRn is applied to the data line 402 during the backward frame period NF, a negative voltage is applied between the gate electrode and the source electrode of the driving transistor 214, so that a change in the threshold voltage Vth of the driving transistor 214 in response to the passage of time can be prevented. That is, when the OLED element 212 is made to emit light without applying the backward bias voltage thereto, there is a tendency for the threshold voltage Vth of the driving transistor 214 to become shifted gradually as time passes. Accordingly, as shown in (a) to (k) of FIG. 5, the backward frame period NF is provided between the forward frame periods PF, and a negative voltage is applied between the gate electrode and the source electrode of the driving transistor 214, and the threshold voltage Vth can be prevented from being shifted. As a result, it is possible to maintain correct gray-scale reproducibility.

When an image is displayed at the timing shown in FIG. 5, one frame period Tv is set to a length corresponding to half of the vertical scanning period in the image inputted to the electro-optical device 100. As a result, the input image can be displayed without losing its frame. In addition, since there is the backward frame period NF between the forward frame periods PF, moving pictures can be clearly seen.

B. Modification of First Embodiment

In the above-mentioned first embodiment, various modifications can be made as follows.

B1.

The backward bias voltage VRn can be set by various methods as well as the equation 1. For example, when a value of the source voltage Vs of the driving transistor 214 at the time of the forward bias is different from a value of the source voltage Vs' at the time of the backward bias, the following equation 2 may be employed to set the backward bias voltage VRn.

$$VRn=Vs'-(Vn-Vs) \quad (2)$$

In addition, values of the source voltage Vs at the time of the forward bias and the source voltage Vs' at the time of the backward bias are experimentally determined in advance.

B2.

In the first embodiment, the backward bias voltage VRn corresponding to the forward bias voltage Vn is applied to each of the pixel circuits 210, but one backward bias voltage VRcommon in common to all the pixel circuits may be applied. In this case, the backward bias voltage VRcommon may be set in accordance with the following equation 3.

$$VR\text{common}=Vs-(V\text{ave}-Vs) \quad (3)$$

Here, Vave is an average value of the forward bias voltage Vn applied to the forward frame.

In addition, a predetermined constant backward bias voltage VRpreset may be applied commonly to all the pixel circuits 210, as shown in the following equation 4 instead of the equation 3.

$$\text{VRcommon}=\text{VRpreset} \quad (3)$$

In this case, the second voltage dividing circuit 412*b* in the data voltage generating circuit 410 shown in FIG. 3 is not necessary, and a circuit for generating the backward bias voltage VRpreset may be provided.

B3.

Figure 7:
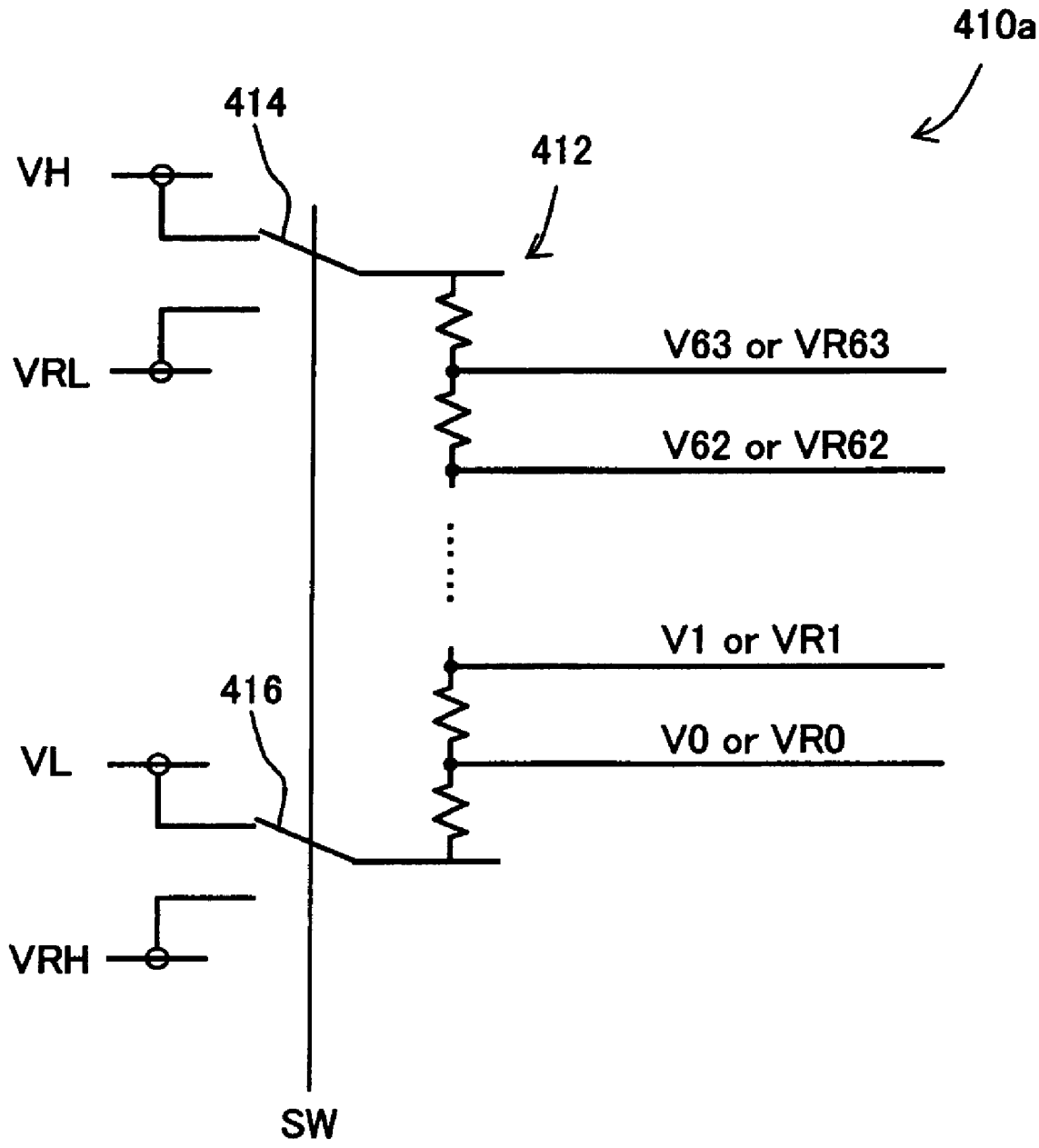
FIG. 7 is a circuit diagram illustrating a structure of a data voltage generating circuit 410*a;*

As the data voltage generating circuit 410, it is possible to employ various structures other than the structure shown in FIG. 3. FIG. 7 shows a structure of another data voltage generating circuit 410*a*. This data voltage generating circuit 410*a* has one voltage dividing circuit 412 and two switch circuits 414 and 416. An upper terminal of the voltage dividing circuit 412 is connected to any one of a high reference voltage VH for forward bias and a low reference voltage VRL for backward bias through the first switch circuit 414. On the other hand, a lower terminal of the voltage dividing circuit 412 is connected to any one of the low reference voltage VL for forward bias and the high reference voltage VRH for backward bias through the second switch circuit 416. This data voltage generating circuit 410*a* has the switch circuits 414 and 416 switched in accordance with the switching signal SW, so that 64 forward bias voltages V0 to V63 or 64 backward bias voltages VR0 to VR63 can be outputted. In addition, in this data voltage generating circuit 410*a*, the number of resistors is a half as compared to the circuit 410 shown in FIG. 3, so that it is possible to decrease the circuit size.

Figure 8:
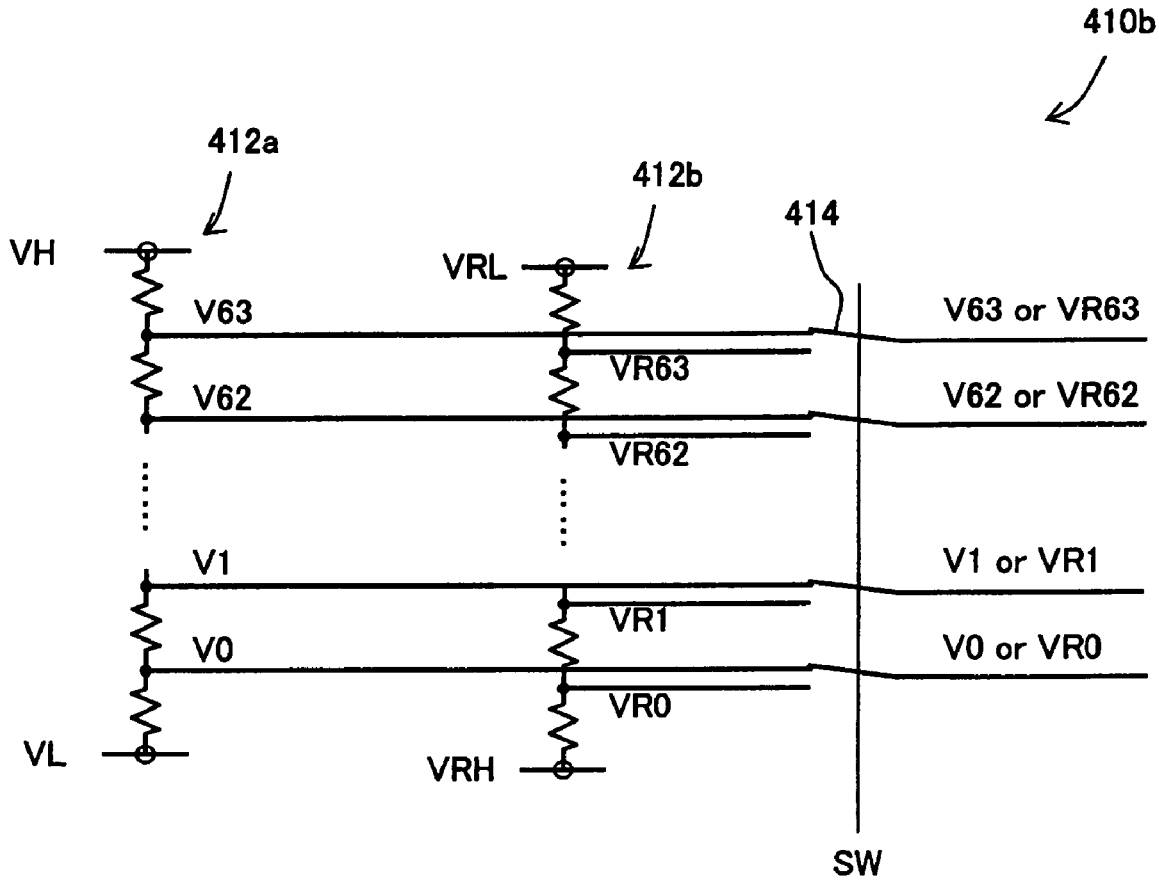
FIG. 8 is a circuit diagram illustrating a structure of another data voltage generating circuit 410*b;*

FIG. 8 shows a structure of another data voltage generating circuit 410*b*. This data voltage generating circuit 410*b* has two voltage dividing circuits 412*a* and 412*b*, and 64 switch circuits 414 in the same manner as FIG. 3. This data voltage generating circuit 410*b* can also allow the forward bias voltages V0 to V63 or the backward bias voltages VR0 to VR63 to be output. In addition, when the data voltage generating circuit 410*b* of FIG. 8 is employed, the number of signal lines between the data voltage generating circuit 410*b* and each selector 420 (of FIG. 3) becomes half of that of the circuit shown in FIG. 3, so that the size of the whole circuit of the data line driving circuit 400 can decrease.

The above-mentioned various modifications can be applied to other embodiments described below.

C. Second Embodiment

Figure 9:
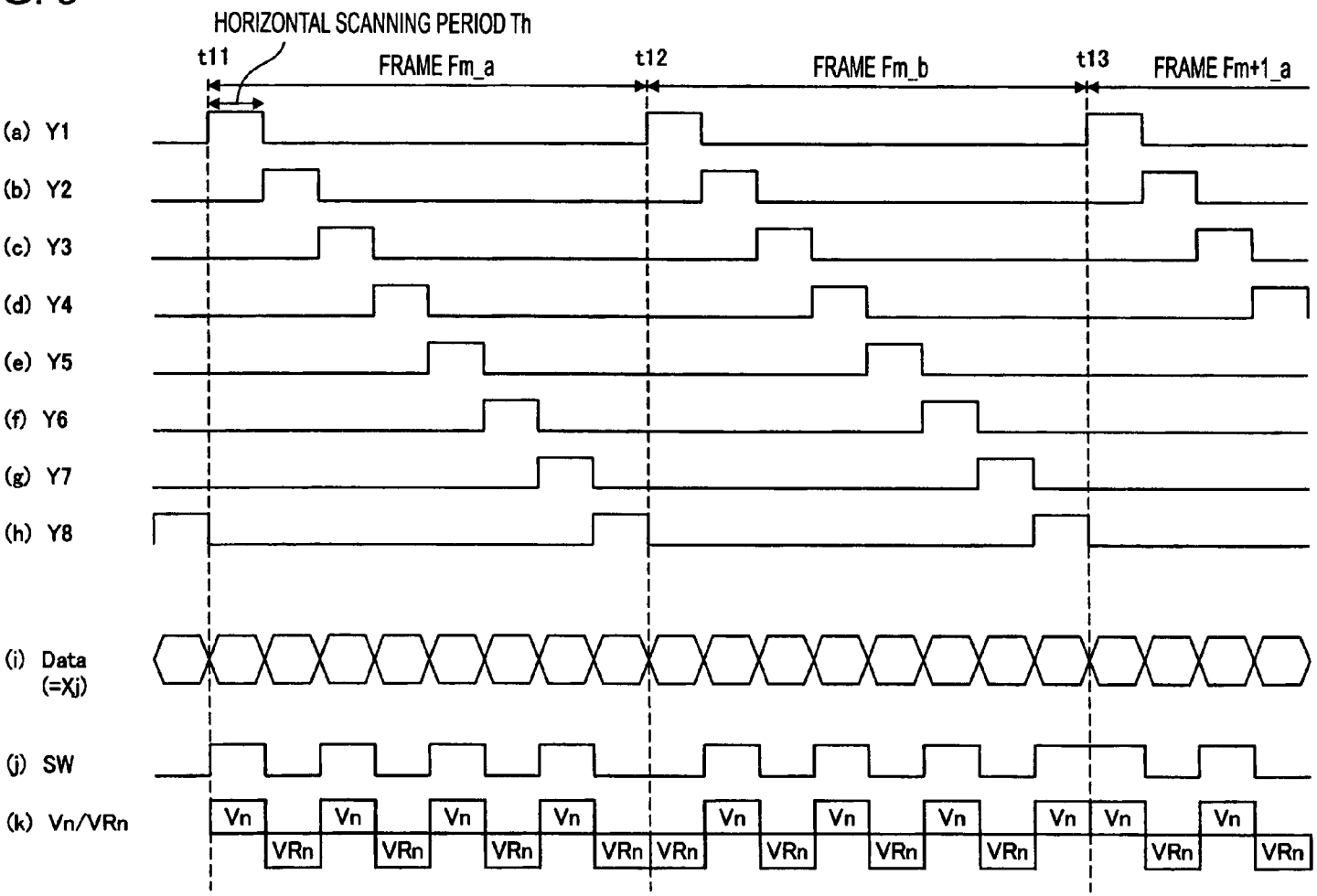
FIG. 9 is a timing chart illustrating the operation of an electro-optical device according to a second embodiment of the invention.

FIG. 9 is a timing chart illustrating the operation of an electro-optical device according to a second embodiment of the invention. The circuit structure of the second embodiment is the same as that of the first embodiment, except for the operation.

FIG. 9 is different from FIG. 5 in the switching signal SW of (j) of FIG. 9 and the bias voltage Vn/VRn of (k) of FIG. 9. The switching signal SW is switched per one scanning line (that is, per one row) in the second embodiment. Accordingly, the bias voltage Vn/VRn is also switched per one scanning line. Specifically, during a frame period Fm-a starting from the time t11, a forward bias voltage Vn is applied to odd-numbered scanning lines and a backward bias voltage VRn is applied to even-numbered scanning lines. In addition, during a frame period Fm-b starting from the time t12, a backward bias voltage VRn is applied to odd-numbered scanning lines and a forward bias voltage Vn is applied to even-numbered scanning lines. In addition, a bias voltage having the same sign as the first frame period Fm-a is applied during a frame period Fm+1-a starting from the next time t13.

Figure 10A:
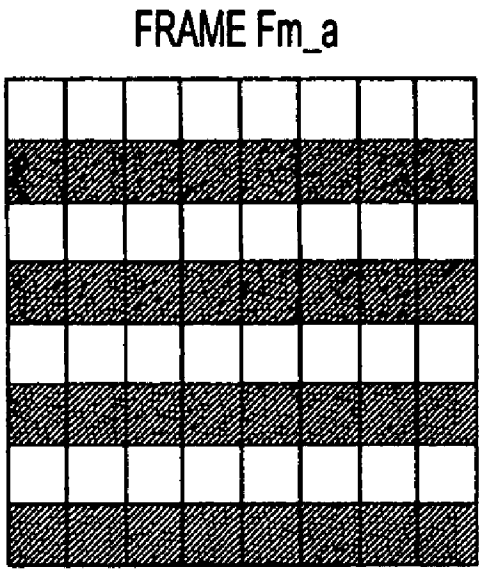
FIG. 10 is a diagram illustrating a setting state of a light emitting gray-scale level in three frame periods Fm_a, Fm_b, and Fm+1_a illustrated in FIG. 9.
Figure 10B:
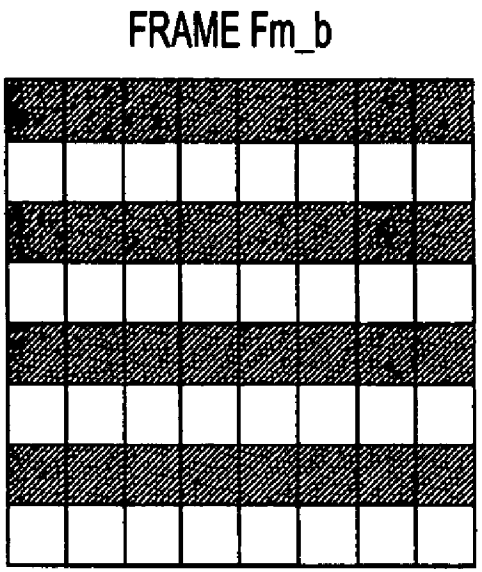
Figure 10C:
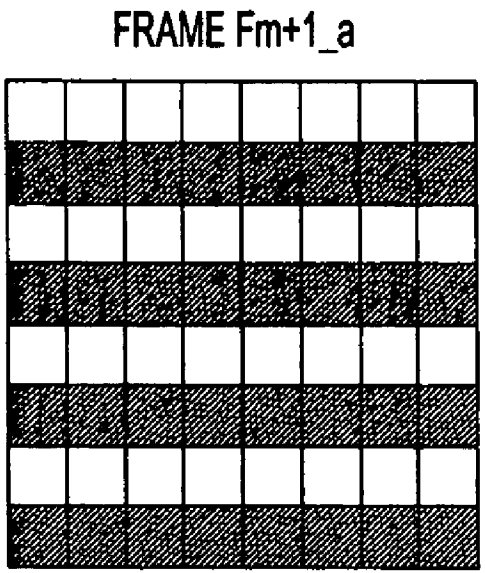

FIG. 10 is a diagram illustrating states of setting light-emitting gray-scale levels at the end of programming in the three frame periods Fm-a, Fm-b, and Fm+1-a of FIG. 9. As can be understood from this, according to the second embodiment, a scanning line to which the forward bias voltage Vn is applied and a scanning line to which the backward bias voltage VRn is applied are switched per one scanning line within one frame period. In addition, referring to one scanning line, it can be seen that a period for which the forward bias voltage Vn is applied and a period for which the backward bias voltage VRn is applied are switched per one frame period.

In all the frame periods Fm-a, Fm-b, and Fm+1-a, a pixel circuit to which the forward bias voltage Vn is applied and a pixel circuit to which the backward bias voltage VRn is applied are within one frame period. Accordingly, these frame periods are called 'a combined frame applying period'.

Also in this second embodiment, the threshold voltage of the driving transistor 214 can also be prevented from being shifted, and correct gray-scale reproducibility can be maintained in the same manner as the first embodiment.

D. Third Embodiment

Figure 11:
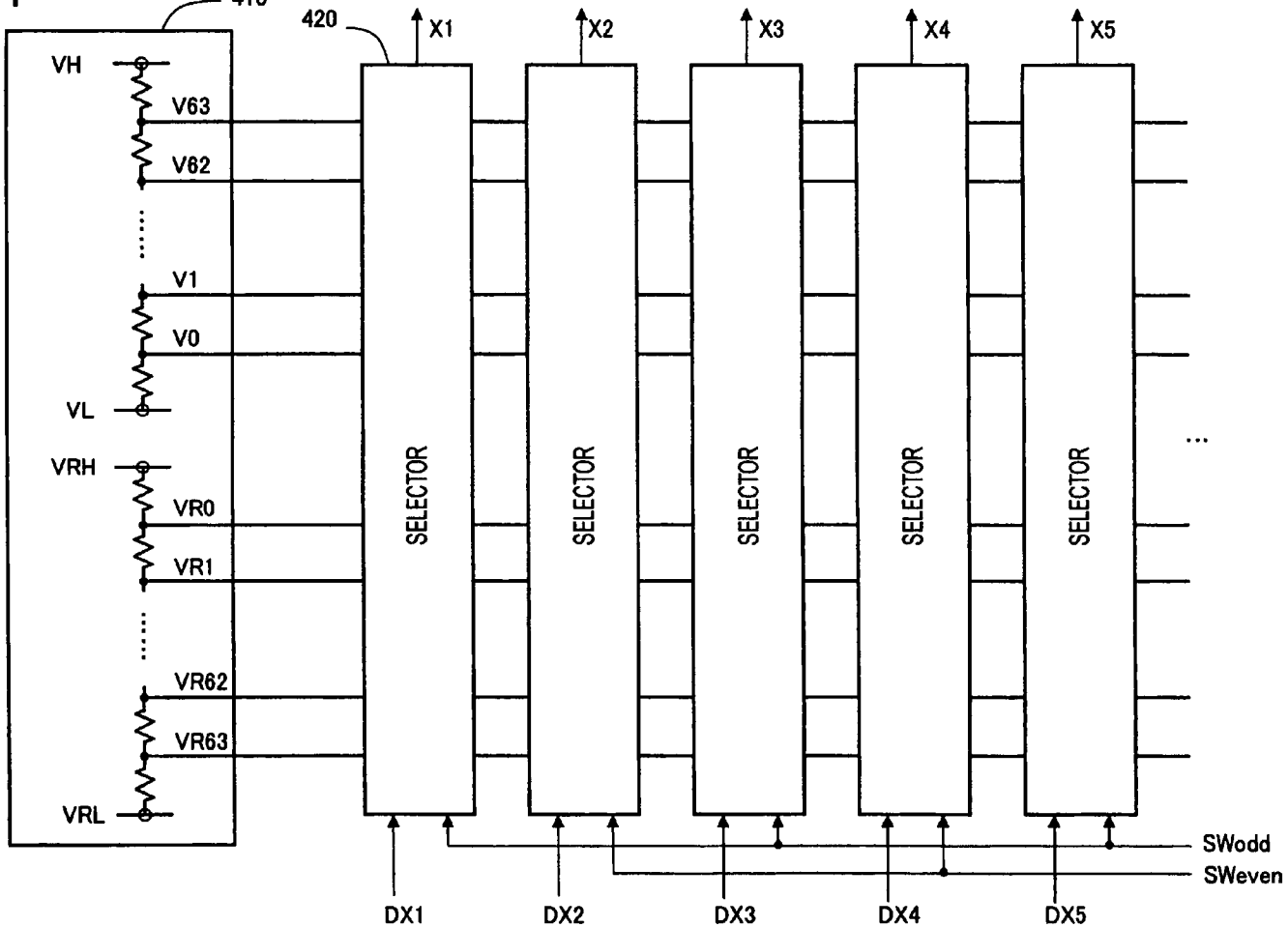
FIG. 11 is a block diagram illustrating an internal structure of a data line driving circuit in a third embodiment of the invention.

FIG. 11 is a block diagram illustrating an internal structure of a data line driving circuit 400 (FIG. 1) according to a third embodiment of the invention. This data line driving circuit is different from that of the first embodiment in that the switching signal SW of FIG. 3 is divided into a switching signal SWodd for odd column and a switching signal SWeven for even column, and the other structure is the same as that of the first embodiment.

Figure 12:
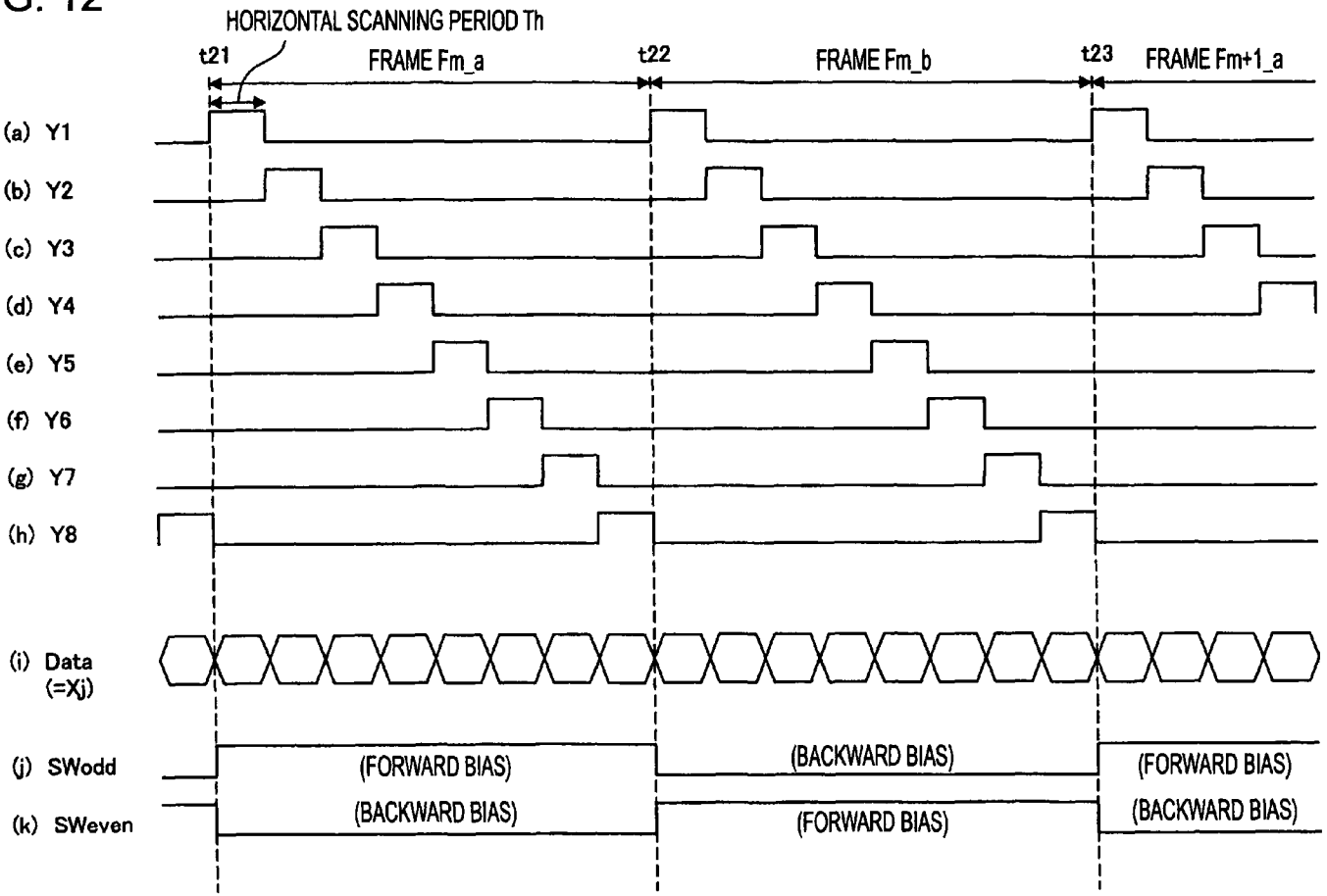
FIG. 12 is a timing chart illustrating the operation of the electro-optical device in the third embodiment.
Figure 13A:
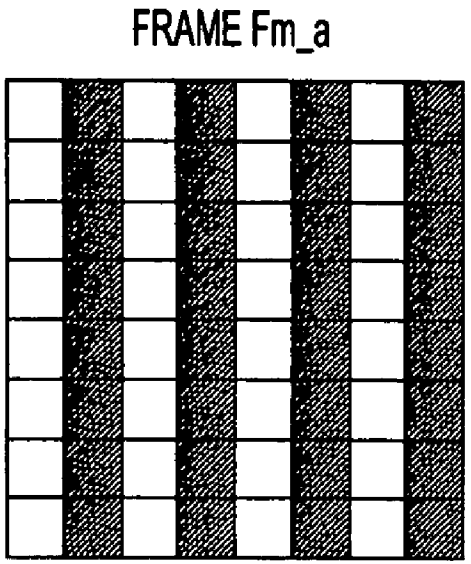
FIG. 13 is a diagram illustrating a setting state of a light emitting gray-scale level in three frame periods Fm_a, Fm_b, and Fm+1_a illustrated in FIG. 12.
Figure 13B:
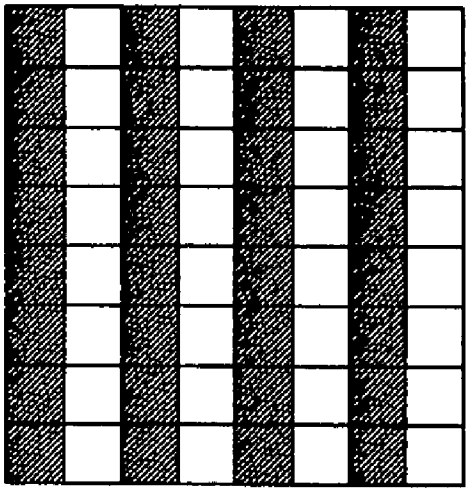
Figure 13C:
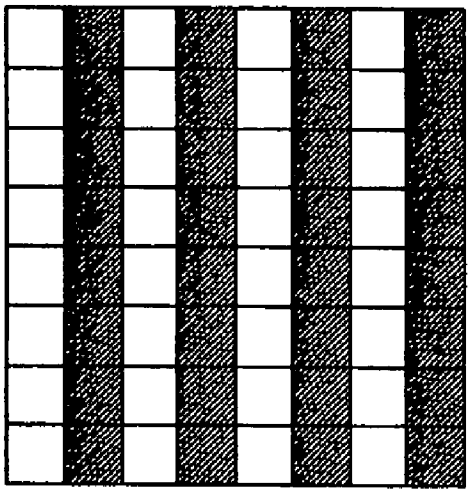
Figure 13C:
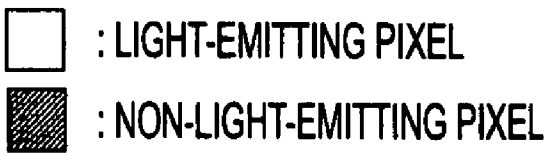

FIG. 12 is a timing chart illustrating the operation of an electro-optical device according to the third embodiment of the invention. Two switching signals SWodd and SWeven are illustrated in (j) and (k) of FIG. 12, and switching of the bias voltage Vn/VRn illustrated in (k) of FIG. 5 and (k) of FIG. 9 is omitted.

In the third embodiment, a period (forward frame period) for which the forward bias voltage is applied and a period (backward frame period) for which the backward bias voltage is applied are switched per one frame in the switching signal SWodd for odd column. Similarly, a period (forward frame period) for which the forward bias voltage is applied and a period (backward frame period) for which the backward bias voltage is applied are switched per one frame in the switching signal SWeven for even column.

FIG. 13 is a diagram illustrating states of setting light-emitting gray-scale levels at the end of programming in the three frame periods Fm-a, Fm-b, and Fm+1-a of FIG. 2. As can be understood from this, in the third embodiment, a pixel column to which the forward bias voltage Vn is applied and a pixel column to which the backward bias voltage VRn is applied are switched per one column within one frame period. In addition, referring to one pixel column, it can be seen that a period for which the forward bias voltage is applied and a period for which the backward bias voltage is applied are switched per one frame period.

Also in this third embodiment, the threshold voltage Vth of the driving transistor 214 can also be prevented from being shifted, and correct gray-scale reproducibility can be maintained, similarly to the first and second embodiments.

E. Fourth Embodiment

Figure 14:
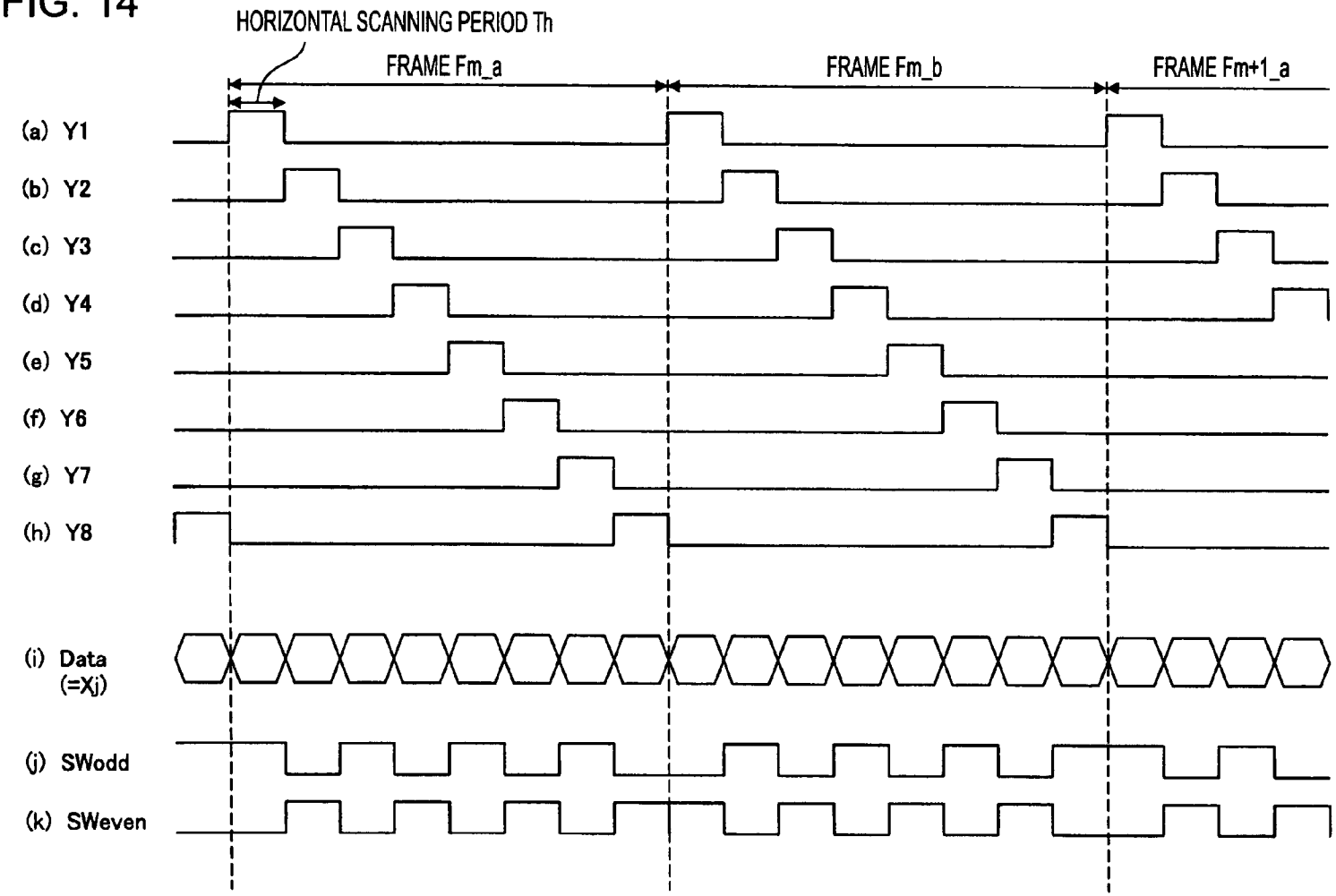
FIG. 14 is a timing chart illustrating the operation of an electro-optical device according to a fourth embodiment of the invention.

FIG. 14 is a timing chart illustrating the operation of an electro-optical device according to a fourth embodiment of the invention. A circuit structure of the fourth embodiment is the same as that of the third embodiment, except for the operation.

FIG. 14 is different from FIG. 12 in two switching signals SWodd and SWeven of (j) and (k) of FIG. 14. In the fourth embodiment, the two switching signals SWodd and SWeven are switched per one scanning line (that is, per one pixel row). In addition, levels of these two switching signals SWodd and SWeven are always opposite to each other. It can be understood that the operation of the fourth embodiment is a combination of the operation of the switching signal SW of the second embodiment illustrated in (j) of FIG. 9 and the operation of the switching signals SWodd and SWeven of the third embodiment illustrated in (j) and (k) of FIG. 12.

Figure 15A:
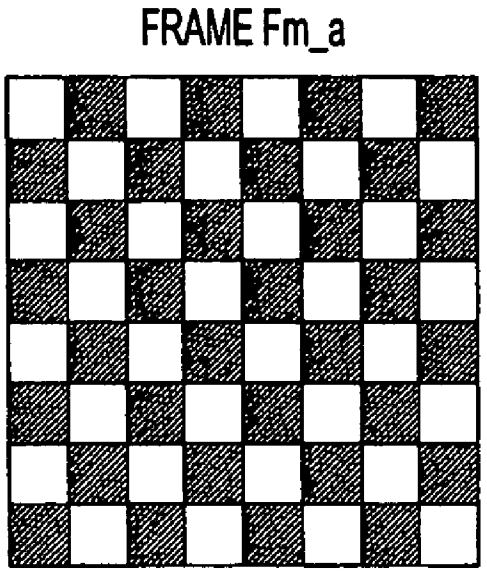
FIG. 15 is a diagram illustrating a setting state of a light emitting gray-scale level in three frame periods Fm_a, Fm_b, and Fm+1_a illustrated in FIG. 14.
Figure 15B:
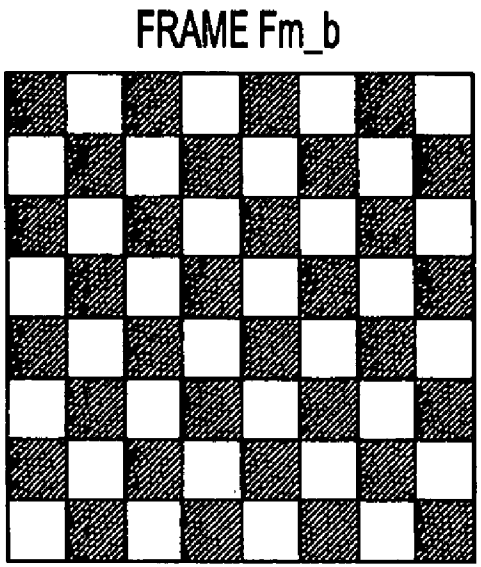
Figure 15C:
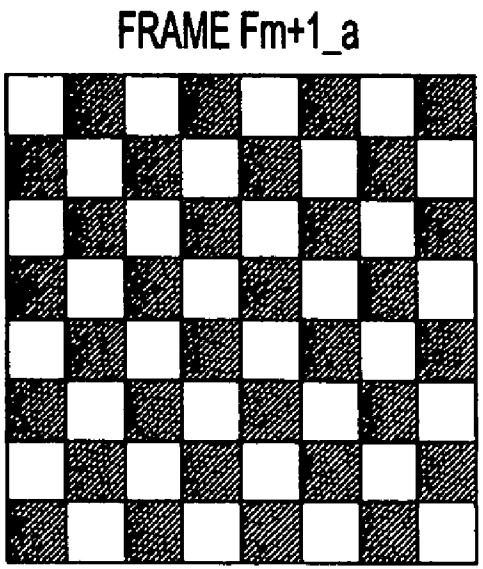

FIG. 15 is a diagram illustrating states of setting light-emitting gray-scale levels at the end of programming in the three frame periods Fm-a, Fm-b, and Fm+1-a of FIG. 14. As can be understood from this, in the fourth embodiment, a pixel to which the forward bias voltage Vn is applied and a pixel to which the backward bias voltage VRn is applied are switched per one pixel within one frame period. However, referring to one pixel, it can be seen that a period for which the forward bias voltage Vn is applied and a period for which the backward bias voltage VRn is applied are alternately switched per one frame period.

Also in this fourth embodiment, the threshold voltage of the driving transistor 214 can also be prevented from being shifted, and correct gray-scale reproducibility can be maintained as is done in the first to third embodiments.

In addition, in the above-mentioned first to fourth embodiments, referring to one pixel, it can be understood that a period (forward frame period) for which the forward bias voltage is applied and a period (backward frame period) for which the backward bias voltage is applied are alternately switched per one frame period. In addition, referring to one frame period (one vertical scanning period), all the pixels can be divided into a pixel group to which the forward bias is applied and a pixel group to which the backward bias is applied. Such a method of dividing the pixel groups is arbitrary, and various methods can be employed for the division. For example, switching between the forward bias and the backward bias can be carried out per pixel block having a predetermined size (for example, per 8×8 pixel). That is, the screen of the electro-optical device 100 can be divided into pixel blocks having a predetermined size, and switching between the forward bias and the backward bias can be carried out per pixel block.

F. Fifth Embodiment

Figure 16:
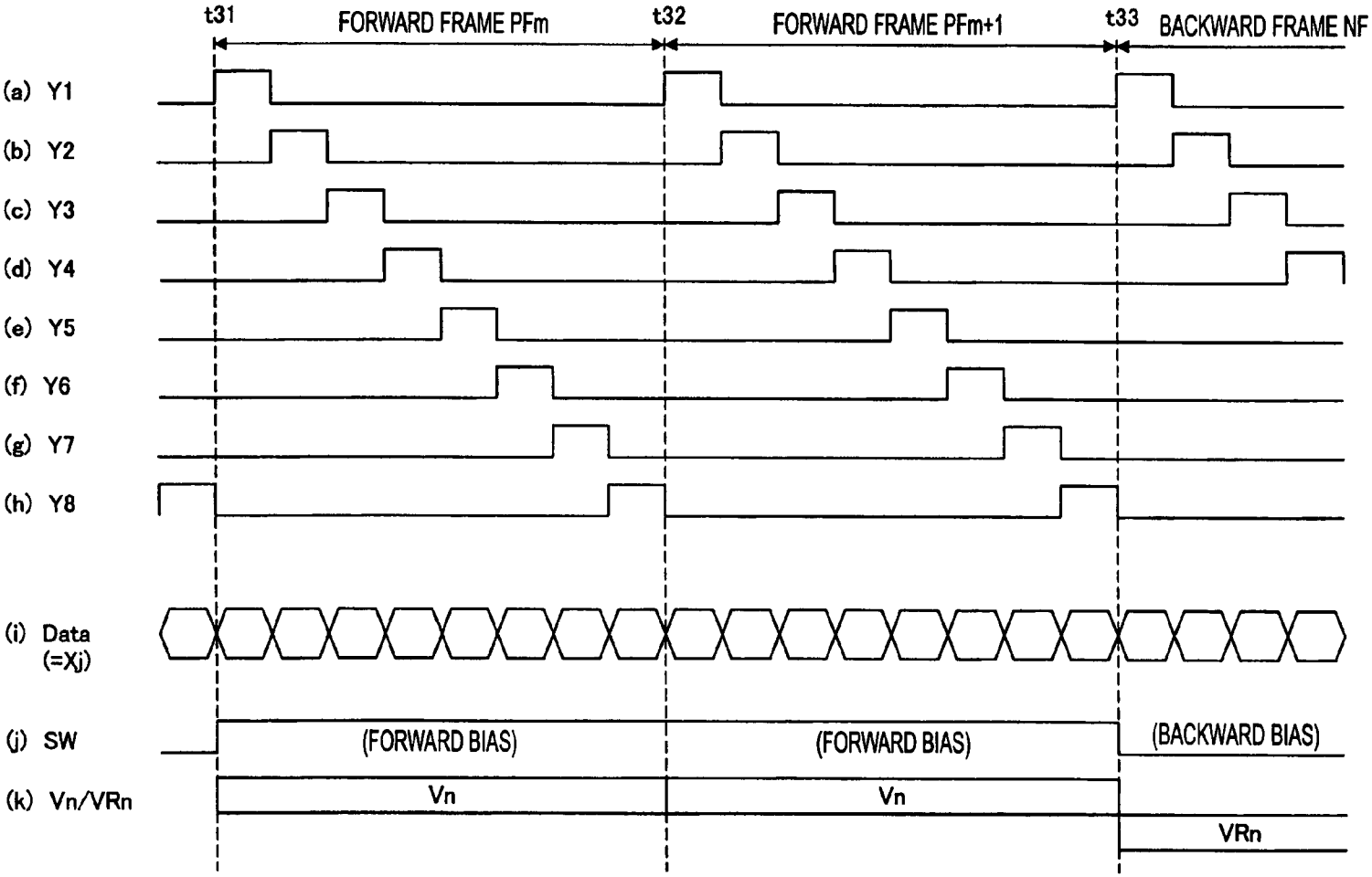
FIG. 16 is a timing chart illustrating the operation of an electro-optical device according to a fifth embodiment of the invention.

FIG. 16 is a timing chart illustrating the operation of an electro-optical device according to a fifth embodiment of the invention. FIG. 16 is different from FIG. 5 (first embodiment) in the switching signal SW of (j) of FIG. 16 and the bias voltage Vn/VRn of (k) of FIG. 16. In the fifth embodiment, the switching signal SW maintains an H level for two frame periods and then becomes an L level for one frame period, which is repeatedly carried out. Accordingly, as shown in (k) of FIG. 16, for the switching of the bias voltage Vn/VRn, the forward bias voltage Vn is applied for the two frame periods, and the backward bias voltage VRn is then applied for the next one frame period. Similar to the first embodiment, in the fifth embodiment, referring to one frame period, any one of the forward bias voltage and the backward bias voltage is applied to all the pixels. Accordingly, in the two forward frame periods PFm and PFm+1 which starts from the respective times t31 and t32, the forward bias voltage Vn is applied to all the pixel circuits. On the other hand, the backward bias voltage VRn is applied to all the pixel circuits in the backward frame period NF starting from the time t33.

As such, the backward frame period NF is applied after the two forward frame periods PF are progressed in the fifth embodiment, so that it is preferable to adjust a value of the backward bias voltage VRn in response to the applied backward frame period.

Figure 17A:
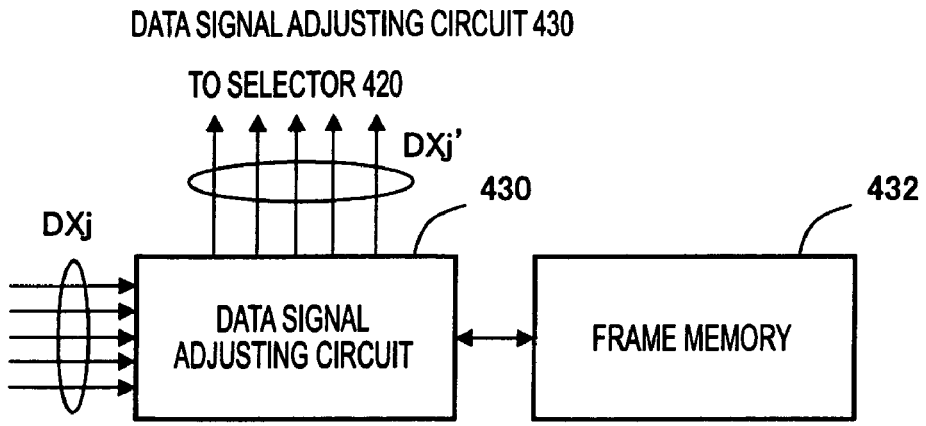
FIG. 17 is a diagram illustrating a structure and a processing content of a data signal adjusting circuit installed in a data line driving circuit.

FIG. 17A is a block diagram illustrating a data signal adjusting circuit 430 provided in the data line driving circuit 400 (FIG. 1) in the fifth embodiment. This data signal adjusting circuit 430 temporarily writes into the frame memory 432 the image data DXj input from the control circuit 500 (FIG. 1) and reads out the image data DXj' from the frame memory 432 to supply it to each selector 420 of FIG. 3. The image data DXj' read out in the backward frame period NF is adjusted by the data signal adjusting circuit 430 as follows.

Figure 17B:
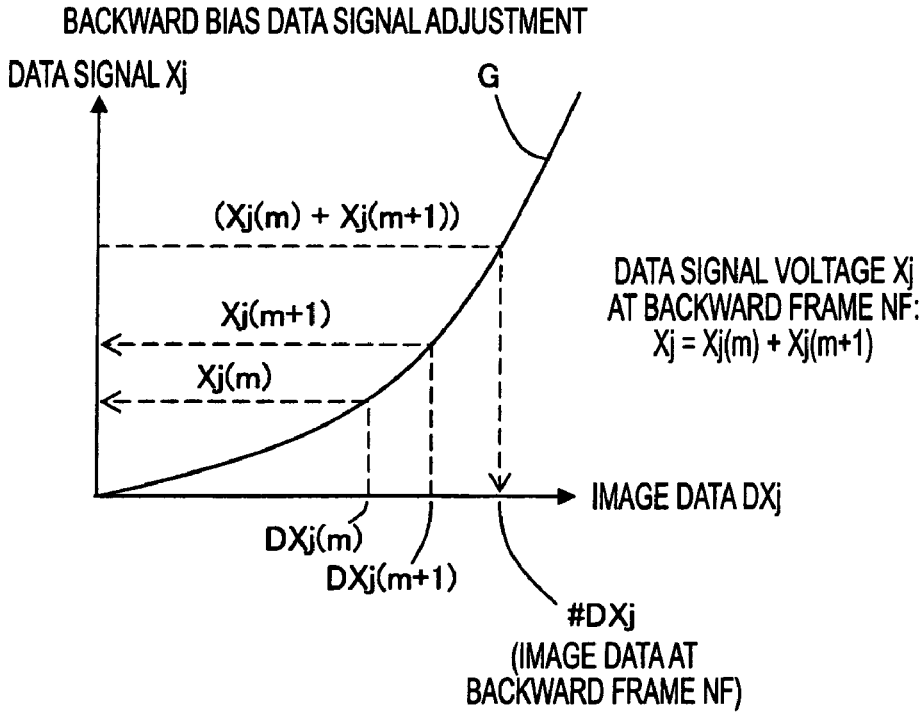

FIG. 17B illustrates a method of adjusting a signal by means of the data signal adjusting circuit 430. The horizontal axis indicates image data DXj to be input, and the vertical axis indicates a voltage level of the data signal Xj. The characteristic G is for forward bias, and can be expressed as the following equation 5.

$$Xj=K(DXj)^{\gamma/2} \tag{5}$$

In this case, K is a constant, γ is a gamma value of the electro-optical device serving as a display device. At the right side of the equation 5, the reason why a value of the image data DXj is DXj to the (γ/2) power is because the light-emitting gray-scale level of the OLED element 212 (FIG. 2) is proportional to the square of the voltage of the data signal Xj.

Referring to FIG. 17B, it is assumed that image data (that is, pixel value) in the m-th forward frame period PFm is DXj(m), and image data in the (m+1)-th forward frame period PFm+1 is DXj(m+1) in any pixel circuit. In this case, data signals Xj(m) and Xj(m+1) supplied to the pixel circuit in the two forward frame periods PFm and PFm+1 are obtained by carrying out conversion on these image data DXj(m) and DXj(m+1) by means of the characteristic G. In addition, the voltage of the data signal Xj desired in applying in the subsequent backward frame period NF becomes a sum of the data signals Xj(m) and Xj(m+1) in the two forward frame periods PFm and PFm+1. In this case, the value #DXj of the image data to be supplied to the selector 420 in the backward frame period NF is set to the value #DXj obtained by carrying out reverse conversion on the sum (Xj(m)+Xj(m+1)) by means of the characteristic G. In addition, adding '#' to the image data in the backward frame is for representing the backward frame, and has the same value as the forward frame image data.

The data signal adjusting circuit 430 carries out processing shown in FIG. 17B. That is, when image data DXj(m) and DXj(m+1) are input in the forward frame periods PFm and PFm+1, image data #DFj which should be read in the backward frame period NF are operated and then stored in the frame memory 432 according to these values. In addition, the image data #DFj is read from the frame memory 432 to be output in the selector 420 in the backward frame period NF.

When the data signal is adjusted in the above-described manner, in a backward frame period NF, a backward bias voltage having the same voltage as the sum of forward bias voltages applied in the two forward frame periods right before the backward frame period can be applied, so that the threshold voltage of the driving transistor 214 can be effectively prevented from being shifted, and correct gray-scale reproducibility can be maintained.

Figure 18:
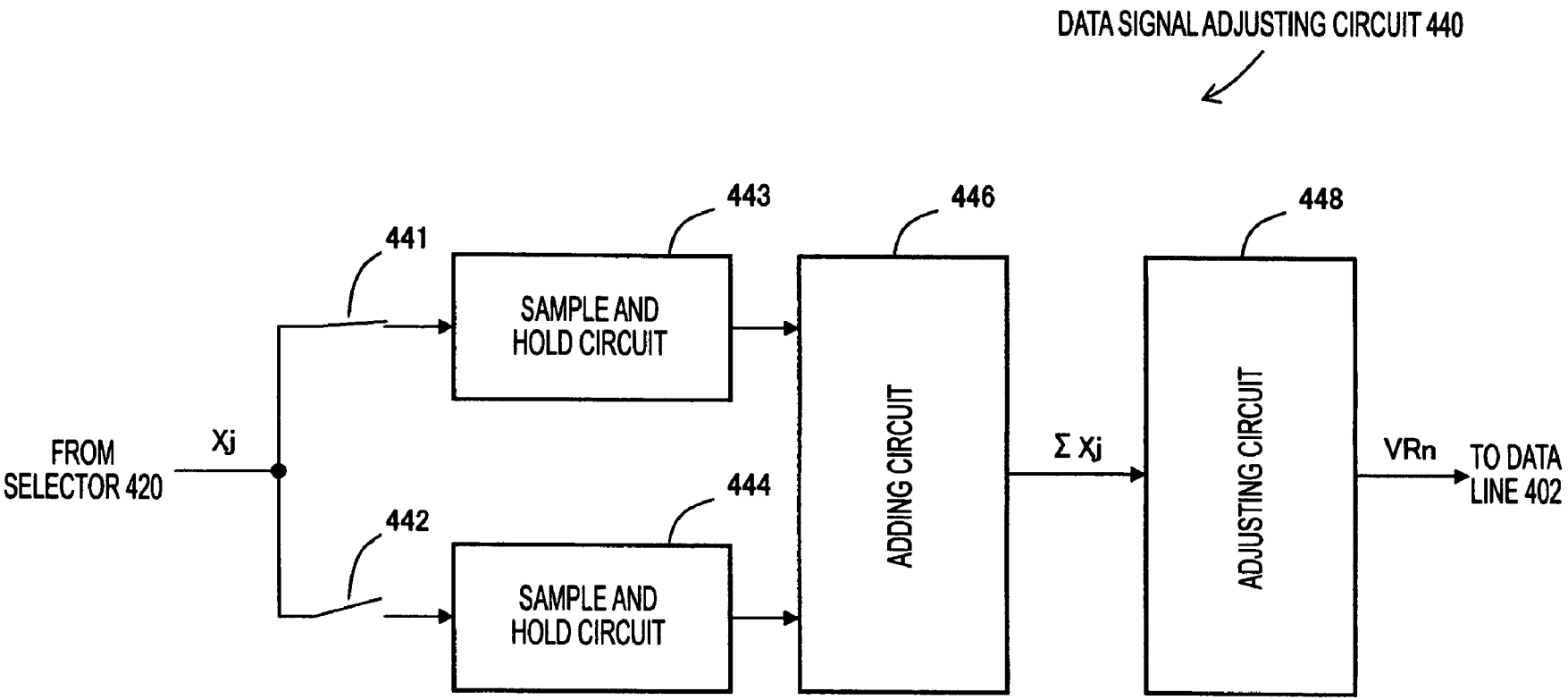
FIG. 18 is a block diagram illustrating another structure of a data signal adjusting circuit.
Figure 19A:
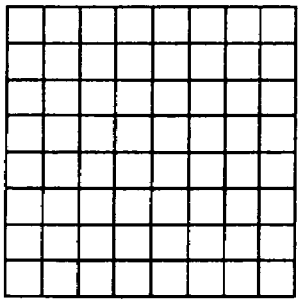
FIG. 19 is an explanatory view illustrating a setting state of a light-emitting gray-scale level in a sixth embodiment.
Figure 19B:
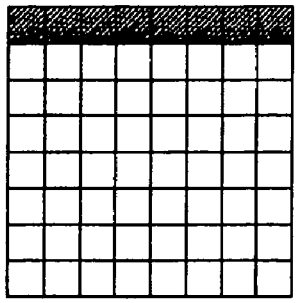
Figure 19C:
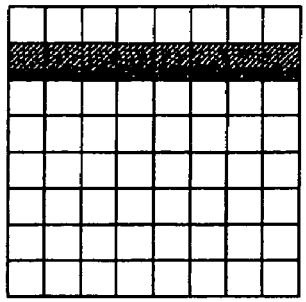
Figure 19D:
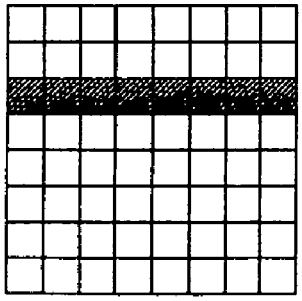
Figure 19E:
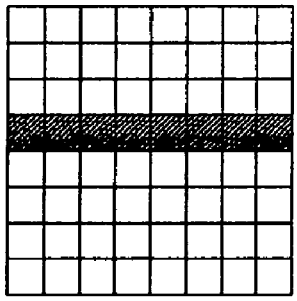
Figure 19F:
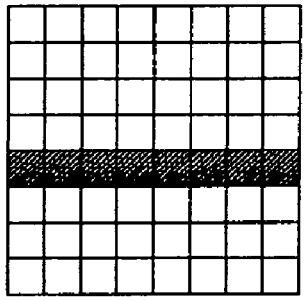
Figure 19G:
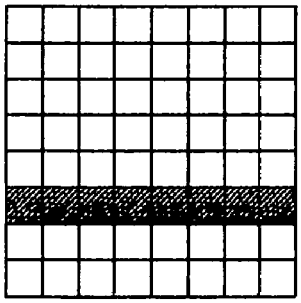
Figure 19H:
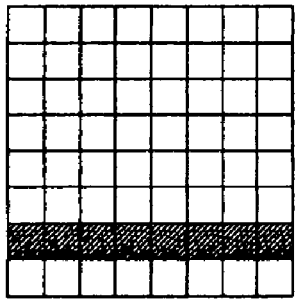
Figure 19I:
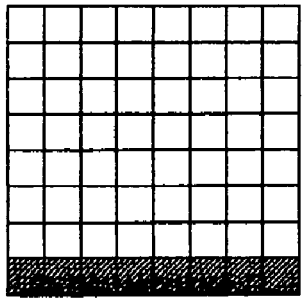

FIG. 18 is a block diagram illustrating another structure of the data signal adjusting circuit. This data signal adjusting circuit 440 is connected to an output end of each selector 420 of FIG. 3, and has two switch circuits 441 and 442, two sample and hold circuits 443 and 444, an adder circuit 446, and an adjusting circuit 448.

In this circuit, data signals Xj(m) and Xj(m+1) in the two forward frame periods PFm and PFm+1 are stored in the sample and hold circuits 443 and 444 via the switch circuits 441 and 442, respectively. In addition, in the backward frame period NF, the data signals Xj(m) and Xj(m+1) are added in the adder circuit 446, so that its sum ΣXj is supplied to the adjusting circuit 448. The regulating circuit 448 converts the sum into a backward bias voltage VRn by regulating gain and offset for the sum ΣXj, and outputs the backward bias voltage VRn onto the data line 402. As such, the backward bias voltage VRn is generated by the adjusting circuit 448 in the circuit of FIG. 18, so that the second voltage dividing circuit 412*b* of FIG. 3 is not necessary.

Also in the fifth embodiment, the threshold voltage of the driving transistor 214 can also be prevented from being shifted, and correct gray-scale reproducibility can be maintained as is done in the first to fourth embodiments. In addition, various modifications of the first embodiment can be applied to the fifth embodiment, and the configuration or operation of the second to fourth embodiments can be applied to the fifth embodiment.

G. Sixth Embodiment

FIG. 19 is a diagram illustrating states of setting light-emitting gray-scale levels in a sixth embodiment of the invention. In this case, states of setting the light-emitting gray-scale levels at the end of programming are illustrated in nine frame periods F1 to F9. A forward bias voltage is applied to all the pixels in the first frame period F1, and a backward bias voltage is applied to a pixel circuit corresponding to one row in each of the frame periods F2 to F9. In addition, the row to which the backward bias voltage is applied is sequentially switched one by one. These frame periods F1 to F9 are repeatedly applied. Accordingly, referring to a pixel circuit group of each row, it can be understood that the forward bias voltage is applied in each of the eight frame periods (eight vertical scanning periods), and the forward bias voltage is applied in the subsequent one frame period, which is repeatedly performed. In addition, the first frame period F1 may be omitted.

In the sixth embodiment, it is also possible that the all the pixel circuits are divided into pixel blocks each corresponding to one row, and a forward bias applying period (forward frame period) and a backward bias applying period (backward frame period) are switched in the predetermined order per pixel block. In addition, the size or shape of the pixel block may be arbitrary, for example, a plurality of pixel circuits corresponding to one column may be employed as one pixel block, or pixel circuits corresponding to a number of rows or columns may be employed as one pixel block.

Also in the sixth embodiment, the threshold voltage of the driving transistor can also be prevented from being shifted, and correct gray-scale reproducibility can be maintained as is done in the first to fifth embodiments.

H. Other Modifications

In addition, the invention is not limited to the above-described embodiments or examples, but various changes can be made without departing from the spirit and scope of the invention, and the following modifications can be employed.

H1. Modification 1

In the fifth embodiment, one backward frame period is inserted after two forward frame periods, but the order of the forward frame period and the backward frame period may be changed. However, referring to each pixel, it is preferable to carry out the forward frame period and the backward frame period the predetermined order. Since the light emitting gray-scale level of an effective image is not set in the backward frame period, it is preferable to insert one backward frame period after M (M is an integer not less than 1) forward frame periods. In this case, the backward bias voltage VRn applied to any pixel in the backward frame period is preferably set by the following equation 6.

$$VRn=\Sigma Vn(m) \tag{6}$$

In this case, Vn(m) is a value of the forward bias voltage in the M-th forward frame period, and the operator Σ denotes the sum of the forward bias voltages.

When the equation 6 is more generalized, the following equation 7 is preferably established.

$$\{\text{forward bias voltage}\times\text{applied period}\}=\{\text{backward bias voltage}\times\text{applied period}\} \tag{7}$$

The equation 6 or 7 does not need to be strictly established. However, it is preferable to determine the backward bias voltage VRn according to the sum ΣVn of M forward bias voltages Vn used in the previous M forward frame periods. In particular, when the backward bias voltage VRn is set such that plus correlation is between the sum ΣVn of the M forward bias voltages Vn and the backward bias voltage VRn, the threshold voltage of the driving transistor 214 can be properly prevented from being shifted.

Similarly, the above-mentioned various modifications can also be applied to the order of the forward frame period and the backward frame period in the sixth embodiment.

H2. Modification 2

The voltage programming-type pixel circuit has been employed in each of the above-mentioned embodiments, but, the invention can also be applied to a current programming-type pixel circuit.

H3. Modification 3

The transistor within the pixel circuit has been formed of amorphous silicon in each of the above-mentioned embodiments, but the invention can also be applied to a case of forming the transistor within the pixel circuit using another semiconductor material.

H4. Modification 4

The electro-optical device 100 using the OLED element 212 serving as a self-emitting element is exemplified in each of the above-mentioned embodiments. However, another self-emitting element can be employed. For example, an inorganic EL element, a field emission display (FED) element, a surface conduction electron emitter display (SED) element, a ballistic electron surface-emitting display (BSD) element, a light-emitting diode (LED) can be employed as the self-emitting element.

H5. Modification 5

Figure 20:
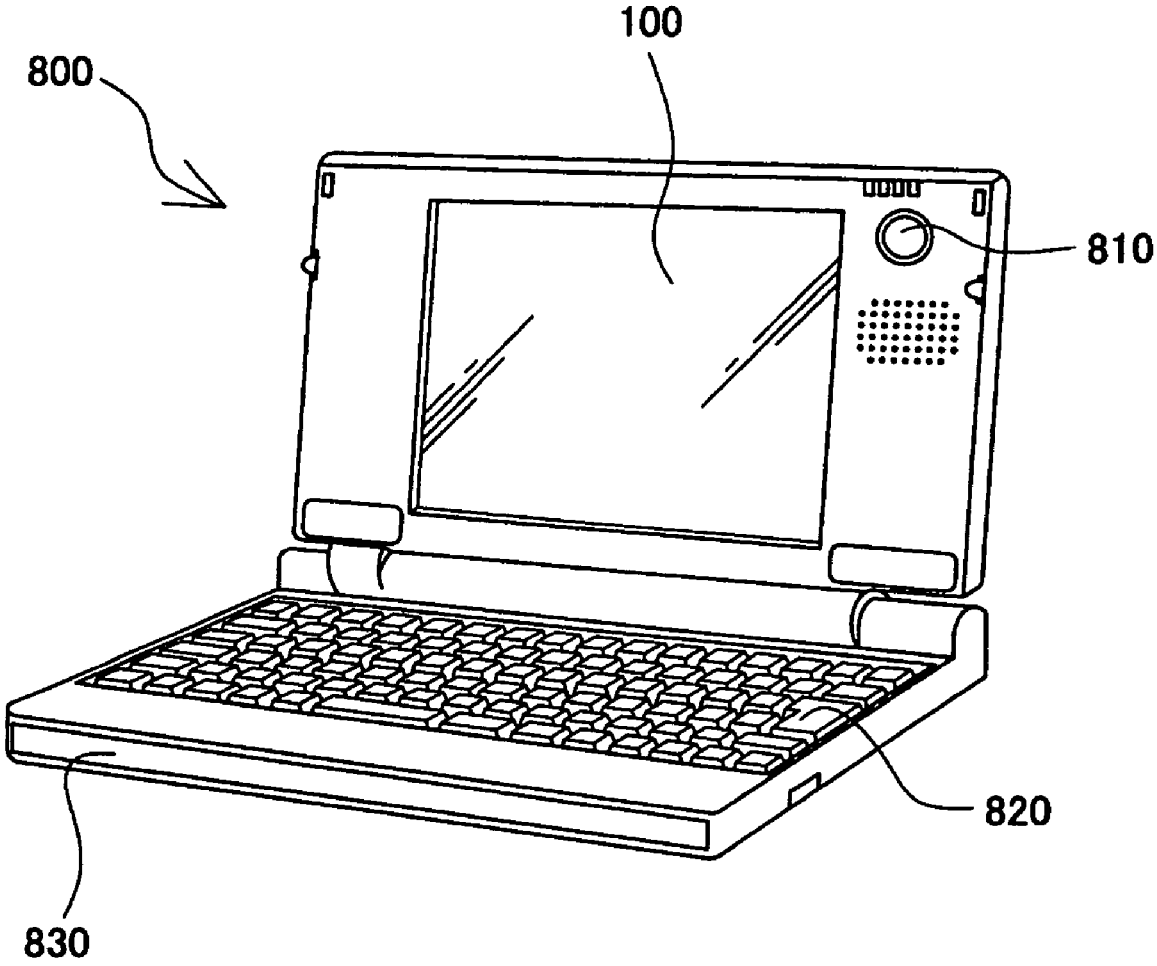
FIG. 20 is a diagram schematically illustrating a structure of a mobile personal computer to which an electro-optical device is applied.

The electro-optical device 100 described in the above-mentioned embodiments can be applied to an electronic apparatus. FIG. 20 is a diagram schematically illustrating a structure of a mobile personal computer to which the electro-optical device is applied. A personal computer 800 has an electro-optical device 100 serving as a display unit, a main body 830, a power switch 810, and a keyboard 820. This electro-optical device 100 employs the OLED element 212 (FIG. 2) as a display unit, so that the viewing angle is large and it is good for easy view.

Electronic apparatus to which the electro-optical device 100 is applied may include, a cellular phone, a personal digital assistant (PDA), a digital still camera, a television, a view-finder-type or monitor-direct-view video tape recorder, a car navigation apparatus, a pager, an electronic note, an electronic calculator, a word processor, a workstation, a video phone, a POS terminal, and an apparatus having a touch panel. The electro-optical device 100 can be applied as display units of these electronic apparatuses. In addition, it can be applied to a recording head of an optical recording printer or an electronic copy machine.

What is claimed is:

1. An electro-optical device comprising:

a plurality of pixel circuits each including a light-emitting element and a driving transistor for driving the light-emitting element;

data lines that are connected to the plurality of pixel circuits and that supply data signals representing light-emitting gray-scale levels to gate electrodes of the driving transistors in the plurality of pixel circuits; and a data line driving circuit that is provided outside the plurality of pixel circuits and supplies the data signals to the pixel circuits through the data lines, wherein the data line driving circuit applies to each pixel circuit in a predetermined sequence two forward frame periods supplying a data signal having a forward bias voltage for making the light-emitting element emit light and a backward frame period supplying a data signal having a backward bias voltage for making the light-emitting element not emit light, and drives each of the plurality of pixel circuits, the forward frame periods and the backward frame period each is a single frame period, the two forward frame periods are consecutive, the backward frame period is applied immediately after the two consecutive forward frame periods, the data line driving circuit applies the backward frame period once after applying the forward frame periods to each of the pixel circuits M times (M is an integer equal to or greater than 2, and determines the backward bias voltage applied to the data line in the backward frame period in accordance with a sum of N forward bias voltages applied to the data line in the forward frame periods for the M times right before the backward frame period, and the data line driving circuit carries out switching between the forward frame periods and the backward frame period in the predetermined sequence.

2. The electro-optical device according to claim 1, wherein the data line driving circuit simultaneously applies any one of the forward frame periods and the backward frame period to all of the plurality of the pixel circuits.

3. The electro-optical device according to claim 1, wherein the plurality of pixel circuits is divided into pixel blocks each having a predetermined size, and the data line driving circuit carries out switching between the forward frame periods and the backward frame period in the predetermined sequence for each of the pixel blocks.

4. The electro-optical device according to claim 3, wherein the plurality of pixel circuits is arranged in a matrix, and each pixel block is composed of a plurality of pixel circuits corresponding to one row.

5. The electro-optical device according to claim 3, wherein the plurality of pixel circuits is arranged in a matrix, and each pixel block is composed of a plurality of pixel circuits corresponding to one column.

6. The electro-optical device according to claim 1, wherein the plurality of pixel circuits are divided into first and second pixel circuit groups, and the data line driving circuit applies a first combined frame applying period for which the forward frame periods are applied to the first pixel circuit group while the backward frame period is applied to the second pixel circuit group, and a second combined frame applying period for which the backward frame period is applied to the first pixel circuit group while the forward frame periods are applied to the second pixel circuit group in the predetermined sequence.

7. The electro-optical device according to claim 6, wherein the first pixel circuit group is discriminated from the second pixel circuit group on a pixel block unit having a predetermined size.

8. The electro-optical device according to claim 7, wherein the plurality of pixel circuits are arranged in a matrix, and the pixel block unit is composed of a plurality of pixel circuits corresponding to one row.

9. The electro-optical device according to claim 7, wherein the plurality of pixel circuits are arranged in a matrix, and the pixel block unit is composed of a plurality of pixel circuits corresponding to one column.

10. The electro-optical device according to claim 1, the data line driving circuit sets the backward bias voltage such that a first value obtained by multiplication of a backward bias voltage applied to the data line and its applying period in the backward frame period, and a second value obtained by multiplication of a forward bias voltage applied to the data line and its applying period in the previous M forward frame periods have the same absolute value but have polarities opposite to each other.

11. The electro-optical device according to claim 1, wherein the data line driving circuit carries out alternative switching between the forward frame periods and the backward frame for each pixel circuit, and sets the backward bias voltage such that a backward bias voltage applied to the data line in the backward frame period and a forward bias voltage applied to the data line in the previous forward frame periods have the same absolute value but have polarities opposite to each other.

12. The electro-optical device according to claim 1, wherein the data line driving circuit sets the backward bias voltage to a predetermined constant value.

13. The electro-optical device according to claim 1, wherein the data line driving circuit includes:

a forward bias generating circuit that generates a plurality of forward bias voltages representing a plurality of light-emitting gray-scale levels;

a backward bias generating circuit that generates a plurality of backward bias voltages each having the same potential difference as and a polarity opposite to each of the plurality of forward bias voltages with respect to a predetermined reference voltage; and a selection circuit that selects any one among the plurality of forward bias voltages and the plurality of backward bias voltages to apply the selected one to the data line.

14. The electro-optical device according to claim 1, wherein the data line driving circuit includes:

a power supply circuit that supplies a high forward bias potential and a low forward bias potential used to generate a plurality of forward bias voltages representing a plurality of light-emitting gray-scale levels, and a high backward bias potential and a low backward bias potential used to generate a plurality of backward bias voltages each having the same potential difference as and a polarity opposite to each of the plurality of forward bias voltages with respect to a predetermined reference voltage;

a voltage dividing circuit having a plurality of resistors, and a plurality of voltage supplying lines for extracting voltages divided by the plurality of resistors;

a first switch that selects any one of the high forward bias potential and the low backward bias potential and connects the selected one to a high voltage terminal of the voltage dividing circuit; and a second switch that selects any one of the low forward bias potential and the high backward bias potential and connects the selected one to a low voltage terminal of the voltage dividing circuit.

15. The electro-optical device according to claim 1, wherein the light-emitting element is an organic electroluminescent (EL) element.

16. The electro-optical device according to claim 1, wherein the driving transistor is a transistor formed of amorphous silicon.

17. An electronic apparatus comprising, as a display device, the electro-optical device according to claim 1.

18. A method of driving an electro-optical device including a plurality of pixel circuits each including a light-emitting element and a driving transistor for driving the light-emitting element; data lines connected to the plurality of pixel circuits to supply data signals representing light-emitting gray-scale levels to gate electrodes of the driving transistors in the plurality of pixel circuits, and a data line driving circuit that is provided outside the plurality of pixel circuits and supplies the data signals to the pixel circuits through the data lines, the method comprising:

applying to each of the plurality of pixel circuits in a predetermined sequence a two forward frame periods supplying a data signal having a forward bias voltage for making the light-emitting element emit light to the pixel circuit, and a backward frame period supplying a data signal having a backward bias voltage for making the light-emitting element not emit light to the pixel circuit; and driving each of the plurality of pixel circuits, wherein the data line driving circuit applies the backward frame period once after applying the forward frame periods to each of the pixel circuits M times (M is an integer equal to or greater than 2, and determines the backward bias voltage applied to the data line in the backward frame period in accordance with a sum of N forward bias voltages applied to the data line in the forward frame periods for the M times right before the backward frame period, wherein the two forward frame periods are consecutive, wherein the backward frame period is applied immediately after the two consecutive forward frame periods, wherein the forward frame periods and the backward frame period each is a single frame period, and wherein the data line driving circuit carries out switching between the forward frame periods and the backward frame period in the predetermined sequence.

19. A method of driving an electro-optical device including a plurality of pixel circuits each including a light-emitting element and a driving transistor for driving the light-emitting element; and data lines connected to the plurality of pixel circuits to supply data signals representing light-emitting gray-scale levels to gate electrodes of the driving transistors in the plurality of pixel circuits, the method comprising:

applying to each of the plurality of pixel circuits in a predetermined sequence two forward frame periods supplying a data signal having a forward bias voltage for making the light-emitting element emit light to the pixel circuit, and a backward frame period supplying a data signal having a backward bias voltage for making the light-emitting element not emit light to the pixel circuit; and driving each of the plurality of pixel circuits, the data signal having a forward bias voltage and the data signal having a backward bias voltage being supplied to each of the plurality of pixel circuits from a data line driving circuit that is provided outside of the pixel circuits, the data line driving circuit applying the backward frame period once after applying the forward frame periods to each of the pixel circuits M times (M is an integer equal to or greater than 2, and determining the backward bias voltage applied to the data line in the backward frame period in accordance with a sum of N forward bias voltages applied to the data line in the forward frame periods for the M times right before the backward frame period, the two forward frame periods being consecutive, the backward frame period being applied immediately after the two consecutive forward frame periods, the forward frame periods and the backward frame period each being a single frame period, and the data line driving circuit carrying out switching between the forward frame periods and the backward frame period in the predetermined sequence.

* * * * *